US007825312B2

(12) United States Patent
Jones et al.

(10) Patent No.: US 7,825,312 B2
(45) Date of Patent: Nov. 2, 2010

(54) PIANOS PLAYABLE IN ACOUSTIC AND SILENT MODES

(75) Inventors: Scott Jones, Boalsburg, PA (US); James M. Lombino, Ashfield, MA (US); Susan Yake Kenagy, Dix Hills, NY (US)

(73) Assignee: Steinway Musical Instruments, Inc., Waltham, MA (US)

( * ) Notice: Subject to any disclaimer, the term of this patent is extended or adjusted under 35 U.S.C. 154(b) by 130 days.

(21) Appl. No.: 12/360,279

(22) Filed: Jan. 27, 2009

(65) Prior Publication Data

US 2009/0211425 A1 Aug. 27, 2009

Related U.S. Application Data

(60) Provisional application No. 61/031,862, filed on Feb. 27, 2008.

(51) Int. Cl.
*G10D 3/18* (2006.01)

(52) U.S. Cl. ..... 84/243

(58) Field of Classification Search ..... 84/236–238, 84/174, 243

See application file for complete search history.

(56) References Cited

U.S. PATENT DOCUMENTS

| | | | |
|---|---|---|---|
| 527,533 | A | 10/1894 | McChesney et al. |
| 782,799 | A | 2/1905 | Smith |
| 3,545,329 | A | 12/1970 | Roehrig |
| 3,559,526 | A | 2/1971 | Raffali |
| 4,061,067 | A | 12/1977 | Carbone |
| 4,194,428 | A | 3/1980 | McFarlin |
| 4,203,341 | A | 5/1980 | Takahashi |
| 4,450,747 | A | 5/1984 | Aoyama |
| 4,679,477 | A | 7/1987 | Monte |
| 4,760,768 | A | 8/1988 | Yamamoto |
| 4,860,626 | A | 8/1989 | Tanaka et al. |

(Continued)

FOREIGN PATENT DOCUMENTS

| | | |
|---|---|---|
| DE | 44 08 505 | 9/1995 |

(Continued)

OTHER PUBLICATIONS

European International Search Report and Written Opinion dated Oct. 13, 2008 in connection with International Application No. PCT/US2008.070045, 19 pages.

(Continued)

*Primary Examiner*—Kimberly R Lockett
(74) *Attorney, Agent, or Firm*—Fish & Richardson P.C.

(57) ABSTRACT

A piano, playable in an acoustic mode and a silent mode, includes a series of keys, a series of key actions, and a series of rotatable hammers. Each key action is actuated by depression of a corresponding key. Each hammer defines a forward throw direction and has a corresponding string. The hammers are driven by corresponding key actions transferring forces from corresponding keys. The piano includes a hammer stopper system that has a blocking rail slidably disposed forward of the hammers. A linear actuator moves the blocking rail along a substantially linear path between a first position, allowing unobstructed movement of the hammers, and a second position blocking at least one hammer from striking its corresponding string. The linear actuator moves the blocking rail to the first position for acoustic play and to the second position for silent play.

40 Claims, 14 Drawing Sheets

U.S. PATENT DOCUMENTS

| | | | | |
|---|---|---|---|---|
| 4,879,939 | A | | 11/1989 | Wall |
| 4,901,614 | A | | 2/1990 | Kumano et al. |
| 5,107,748 | A | | 4/1992 | Muramatsu et al. |
| 5,125,309 | A | | 6/1992 | Stanwood |
| 5,192,820 | A | | 3/1993 | Kawamura et al. |
| 5,194,685 | A | | 3/1993 | Kawamura et al. |
| 5,196,638 | A | | 3/1993 | Hayashida et al. |
| 5,210,367 | A | | 5/1993 | Taguchi et al. |
| 5,235,892 | A | | 8/1993 | Terada et al. |
| 5,239,907 | A | | 8/1993 | Sugiyama et al. |
| 5,272,950 | A | | 12/1993 | Petersen |
| 5,286,915 | A | | 2/1994 | Komano et al. |
| 5,353,671 | A | | 10/1994 | Inoue et al. |
| 5,374,775 | A | | 12/1994 | Kawamura et al. |
| 5,386,083 | A | | 1/1995 | Kawamura |
| 5,410,937 | A | | 5/1995 | Okamato et al. |
| 5,428,186 | A | | 6/1995 | Kaneko et al. |
| 5,434,349 | A | | 7/1995 | Kawamura |
| 5,444,181 | A | | 8/1995 | Wada et al. |
| 5,451,706 | A | | 9/1995 | Yamamoto et al. |
| 5,463,184 | A | | 10/1995 | Kawamura |
| 5,483,861 | A | | 1/1996 | Kawamura et al. |
| 5,506,369 | A | | 4/1996 | Kawamura et al. |
| 5,509,340 | A | | 4/1996 | Kawamura |
| 5,524,519 | A | | 6/1996 | Matsunaga et al. |
| 5,528,969 | A | | 6/1996 | Kihara et al. |
| 5,530,198 | A | | 6/1996 | Ishii |
| 5,539,142 | A | | 7/1996 | Emerson et al. |
| 5,541,353 | A | | 7/1996 | Kawamura et al. |
| 5,542,328 | A | | 8/1996 | Pimentel |
| 5,545,839 | A | | 8/1996 | Kawamura et al. |
| 5,552,559 | A | | 9/1996 | Sugiyama et al. |
| 5,552,560 | A | | 9/1996 | Ura |
| 5,552,561 | A | | 9/1996 | Nakada et al. |
| 5,557,052 | A | | 9/1996 | Hayashida et al. |
| 5,565,636 | A | | 10/1996 | Sugiyama |
| 5,567,902 | A | | 10/1996 | Kimble et al. |
| 5,571,982 | A | | 11/1996 | Masubuchi |
| 5,574,241 | A | | 11/1996 | Kumano et al. |
| 5,583,306 | A | | 12/1996 | Hayashida et al. |
| 5,583,310 | A | | 12/1996 | Sugiyama et al. |
| 5,591,927 | A | | 1/1997 | Kawamura et al. |
| 5,594,188 | A | * | 1/1997 | Kawamura et al. ..... 84/171 |
| 5,600,077 | A | | 2/1997 | Honda |
| 5,602,351 | A | | 2/1997 | Kawamura et al. |
| 5,608,175 | A | | 3/1997 | Kawamura |
| 5,610,356 | A | | 3/1997 | Koseki et al. |
| 5,612,502 | A | | 3/1997 | Ura |
| 5,616,880 | A | | 4/1997 | Hayashida et al. |
| 5,641,930 | A | | 6/1997 | Nakada et al. |
| 5,646,359 | A | | 7/1997 | Kihara et al. |
| 5,648,621 | A | | 7/1997 | Sasaki |
| 5,652,399 | A | | 7/1997 | Fujiwara et al. |
| 5,652,403 | A | | 7/1997 | Sugiyama et al. |
| 5,663,513 | A | | 9/1997 | Sugiyama et al. |
| 5,741,995 | A | | 4/1998 | Kawamura et al. |
| 5,796,023 | A | | 8/1998 | Kumano et al. |
| 5,804,816 | A | | 9/1998 | Yamamoto et al. |
| 5,811,702 | A | | 9/1998 | Tomizawa et al. |
| 5,821,443 | A | | 10/1998 | Masubushi |
| 5,824,928 | A | | 10/1998 | Kumano et al. |
| 5,824,930 | A | | 10/1998 | Ura et al. |
| 5,834,668 | A | | 11/1998 | Kumano et al. |
| 5,837,911 | A | | 11/1998 | Inoue |
| 5,844,154 | A | | 12/1998 | Kimble |
| 5,861,566 | A | | 1/1999 | Kaneko et al. |
| 5,874,687 | A | | 2/1999 | Kawamura |
| 5,880,389 | A | | 3/1999 | Muramatsu |
| 5,880,393 | A | | 3/1999 | Kaneko et al. |
| 5,895,875 | A | | 4/1999 | Osuga et al. |
| 5,909,028 | A | | 6/1999 | Yamamoto |
| 5,925,844 | A | | 7/1999 | Inaba |
| 5,932,825 | A | | 8/1999 | Kumano et al. |
| 5,942,702 | A | | 8/1999 | Inoue |
| 5,942,705 | A | | 8/1999 | Kumano et al. |
| 5,945,613 | A | | 8/1999 | Kimble |
| 5,949,013 | A | | 9/1999 | Satoshi |
| 5,977,466 | A | | 11/1999 | Muramatsu |
| 5,994,632 | A | | 11/1999 | Muramatsu et al. |
| 6,005,178 | A | | 12/1999 | Osuga et al. |
| 6,011,214 | A | | 1/2000 | Kawamura |
| 6,075,213 | A | | 6/2000 | Ichiro |
| 6,084,167 | A | | 7/2000 | Akimoto et al. |
| 6,147,289 | A | | 11/2000 | Kumano |
| 6,194,649 | B1 | | 2/2001 | Itou et al. |
| 6,199,649 | B1 | | 3/2001 | Alanko |
| 6,229,081 | B1 | | 5/2001 | Ura et al. |
| 6,245,985 | B1 | | 6/2001 | Sasaki et al. |
| 6,265,647 | B1 | | 7/2001 | Tamaki et al. |
| 6,271,447 | B1 | | 8/2001 | Fujiwara et al. |
| 6,281,422 | B1 | | 8/2001 | Kawamura |
| 6,288,313 | B1 | | 9/2001 | Sato et al. |
| 6,297,437 | B1 | | 10/2001 | Ura et al. |
| 6,359,207 | B1 | | 3/2002 | Oba et al. |
| 6,362,412 | B1 | | 3/2002 | Ura |
| 6,365,820 | B1 | | 4/2002 | Kondo et al. |
| 6,376,759 | B1 | | 4/2002 | Suzuki |
| 6,380,469 | B2 | | 4/2002 | Uehara |
| 6,380,470 | B1 | | 4/2002 | Fujiwara et al. |
| 6,380,472 | B1 | | 4/2002 | Sugiyama et al. |
| 6,380,473 | B2 | | 4/2002 | Uehara |
| 6,392,132 | B2 | | 5/2002 | Uehara |
| 6,407,321 | B2 | | 6/2002 | Tamaki et al. |
| 6,407,326 | B1 | | 6/2002 | Kondo |
| 6,417,439 | B2 | | 7/2002 | Uehara et al. |
| 6,417,440 | B2 | | 7/2002 | Furuki |
| 6,420,642 | B1 | | 7/2002 | Muramatsu et al. |
| 6,423,889 | B2 | | 7/2002 | Inoue |
| 6,448,481 | B2 | | 9/2002 | Maehara et al. |
| 6,452,079 | B2 | | 9/2002 | Sugiyama et al. |
| 6,476,304 | B2 | | 11/2002 | Uehara |
| 6,515,213 | B2 | | 2/2003 | Muramatsu et al. |
| 6,528,713 | B2 | | 3/2003 | Maehara |
| 6,552,251 | B2 | | 4/2003 | Muramatsu et al. |
| 6,600,097 | B2 | | 7/2003 | Shiiya |
| 6,649,821 | B2 | | 11/2003 | Inoue |
| 6,660,917 | B2 | | 12/2003 | Goto et al. |
| 6,670,532 | B2 | | 12/2003 | Maehara |
| 6,683,242 | B2 | | 1/2004 | Inoue et al. |
| 6,713,751 | B2 | | 3/2004 | Muramatsu et al. |
| 6,730,839 | B2 | | 5/2004 | Itou |
| 6,737,571 | B2 | | 5/2004 | Furukawa |
| 6,765,142 | B2 | | 7/2004 | Sakurada et al. |
| 6,815,603 | B2 | | 11/2004 | Kato et al. |
| 6,864,412 | B2 | | 3/2005 | Ichikawa |
| 6,867,359 | B2 | | 3/2005 | Koseki et al. |
| 6,870,151 | B2 | | 3/2005 | Kato |
| 6,933,435 | B2 | | 8/2005 | Kato et al. |
| 6,933,494 | B2 | | 8/2005 | Kato et al. |
| 6,940,005 | B2 | | 9/2005 | Muramatsu et al. |
| 6,965,070 | B2 | | 11/2005 | Wenjun |
| 6,969,791 | B2 | | 11/2005 | Fujiwara |
| 6,992,241 | B2 | | 1/2006 | Fujiwara |
| 6,992,242 | B2 | | 1/2006 | Shirayanagi et al. |
| 6,995,308 | B2 | | 2/2006 | Nishida et al. |
| 7,005,570 | B2 | | 2/2006 | Nishitani |
| 7,009,095 | B2 | | 3/2006 | Ichikawa et al. |
| 7,012,178 | B2 | | 3/2006 | Muramatsu |
| 7,044,655 | B2 | | 5/2006 | Kato et al. |
| 7,049,576 | B2 | | 5/2006 | Kato et al. |
| 7,057,101 | B2 | | 6/2006 | Ishida |
| 7,094,961 | B2 | | 8/2006 | Ura et al. |
| 7,121,737 | B2 | | 10/2006 | Kato et al. |
| 7,132,643 | B2 | | 11/2006 | Kato |

| | | | |
|---|---|---|---|
| 7,161,137 | B2 | 1/2007 | Ura et al. |
| 7,176,370 | B2 | 2/2007 | Osuga et al. |
| 7,179,974 | B2 | 2/2007 | Muramatsu |
| 7,186,967 | B2 | 3/2007 | Kato |
| 7,217,877 | B2 | 5/2007 | Funaki |
| 7,238,868 | B2 | 7/2007 | Muramatsu et al. |
| 7,259,313 | B2 | 8/2007 | Suzuki et al. |
| 7,265,281 | B2 | 9/2007 | Sasaki et al. |
| 7,268,289 | B2 | 9/2007 | Muramatsu et al. |
| 7,285,715 | B2 | 10/2007 | Sasaki et al. |
| 7,326,844 | B2 | 2/2008 | Nishida |
| 7,332,663 | B2 | 2/2008 | Nishida |
| 7,345,235 | B2 | 3/2008 | Izutani et al. |
| 7,355,109 | B2 | 4/2008 | Muramatsu et al. |
| 7,365,259 | B2 | 4/2008 | Nishida |
| 7,368,644 | B2 | 5/2008 | Shirayangi et al. |
| 7,390,956 | B2 | 6/2008 | Fujiwara |
| 7,402,741 | B2 | 7/2008 | Funaki et al. |
| 7,405,350 | B2 | 7/2008 | Sasaki |
| 7,420,116 | B2 | 9/2008 | Fujiwara |
| 7,432,429 | B2 | 10/2008 | Muramatsu et al. |
| 7,432,430 | B2 | 10/2008 | Sasaki |
| 7,435,895 | B2 | 10/2008 | Muramatsu |
| 7,465,863 | B2 | 12/2008 | Nishida |
| 7,485,798 | B2 | 2/2009 | Nishida |
| 7,488,884 | B2 | 2/2009 | Ohno et al. |
| 7,488,885 | B2 | 2/2009 | Watanabe |
| 2001/0007219 | A1 | 7/2001 | Uehara et al. |
| 2001/0007220 | A1 | 7/2001 | Koseki et al. |
| 2001/0007221 | A1 | 7/2001 | Uehara |
| 2001/0035086 | A1 | 11/2001 | Sugiyama et al. |
| 2002/0059862 | A1 | 5/2002 | Muramatsu et al. |
| 2002/0062728 | A1 | 5/2002 | Muramatsu et al. |
| 2002/0194986 | A1 | 12/2002 | Kato et al. |
| 2003/0070526 | A1 | 4/2003 | Muramatsu et al. |
| 2003/0110897 | A1 | 6/2003 | Itou |
| 2004/0003708 | A1 | 1/2004 | Buchla |
| 2004/0025674 | A1 | 2/2004 | Muramatsu et al. |
| 2004/0168564 | A1 | 9/2004 | Koseki et al. |
| 2004/0221711 | A1 | 11/2004 | Kato et al. |
| 2005/0145087 | A1 | 7/2005 | Fujiwara |
| 2007/0000369 | A1 | 1/2007 | Okuyama |

FOREIGN PATENT DOCUMENTS

| | | | |
|---|---|---|---|
| DE | 195 27 270 | | 1/1997 |
| DE | 10 2005 017758 | | 8/2006 |
| EP | 0573963 | A2 | 12/1993 |
| EP | 0617403 | A2 | 9/1994 |
| EP | 0689183 | A | 12/1995 |
| JP | 63216099 | | 9/1988 |
| JP | 0174807 | | 6/1992 |
| JP | 06059667 | | 8/1994 |
| JP | 6289853 | | 10/1994 |
| JP | 191664(A) | | 7/1995 |
| JP | 07210150 | | 8/1995 |
| JP | 07271347(A) | | 10/1995 |
| JP | 8036380 | | 2/1996 |
| JP | 8063149(A) | | 3/1996 |
| JP | 8123403 | | 5/1996 |
| JP | 2737590 | | 1/1998 |
| JP | 2901864 | | 3/1999 |
| JP | 200322052 | | 11/2000 |
| JP | 3203784 | | 6/2001 |
| JP | 3279307 | | 2/2002 |
| JP | 3292164 | | 3/2002 |
| JP | 3364354 | | 10/2002 |
| JP | 3360390(B2) | | 12/2002 |
| JP | 2003-084753 | | 3/2003 |
| JP | 3438308(B2) | | 8/2003 |
| JP | 3456243 | | 8/2003 |
| JP | 2003066947 | | 8/2003 |
| JP | 3485966 | | 10/2003 |
| JP | 2004094277 | | 3/2004 |
| JP | 3569660 | | 6/2004 |
| JP | 3714349 | | 2/2005 |
| JP | 2005134926 | | 5/2005 |
| JP | 3693047 | | 7/2005 |
| JP | 2005258461 | | 9/2005 |
| JP | 3873522 | | 2/2006 |
| JP | 3823999 | | 7/2006 |
| JP | 3832500 | | 7/2006 |
| JP | 3861906 | | 10/2006 |
| WO | WO 00/70600 | | 11/2000 |
| WO | WO 2009/017961 | | 2/2009 |

OTHER PUBLICATIONS

International Search Report and Written Opinion in connection with International Application No. PCT/US2009/032097, dated Jul. 16, 2009.

International Search Report and Written Opinion in connection with International Application No. PCT/US2009/043767, dated Aug. 11, 2009.

* cited by examiner

PIANOS PLAYABLE IN ACOUSTIC AND SILENT MODES

CROSS REFERENCE TO RELATED APPLICATIONS

This U.S. patent claims priority under 35 U.S.C. §119(e) to U.S. Provisional Application 61/031,862, filed Feb. 27, 2008. The disclosure of the prior application is considered part of and is hereby incorporated by reference in the disclosure of this application.

TECHNICAL FIELD

This disclosure relates to pianos playable in both acoustic and silent modes.

BACKGROUND

The acoustic piano employs distinct and separate systems to transfer energy from a finger or actuator input force into an auditory, vibrational force. The transmission system, commonly called the action, is a network of levers, cushions and hammers which accept finger/actuator input force through a collection of pivotal levers, known as keys. The keys and action focus this input force into rotating hammers of proportional density which are positioned to strike against tensioned wire strings. Both hammers and their corresponding strings are carefully constructed to match their acoustic properties, resulting in a tapered or graduated "scale" of components which cumulatively produce a multiple note span of musical frequencies. The strings act as media through which vibrational energy is transferred into an amplifier such as a soundboard, or electric speaker, where it ultimately is converted into audible sound.

Pianos can produce a wide range of volume. Large pianos can further expand this range to include very loud sounds, as heard in concert pianos which are expected to broadcast over an orchestra without the assistance of electric amplification. Pianos are prevalent in many cultures worldwide. They are present in many households, schools, institutions etc. Inevitably, this proximity of volume producing instruments creates situations where sound control and reduction are necessary. Many piano manufacturers have provided muting mechanisms within the piano to selectively restrict its volume level. These mechanisms typically include a rotating rail which inserts an impact-absorbing material of varying density between the hammers and strings. One conventional (prior art) mute rail system 10, as shown in FIG. 1, includes a key 1, an action 2 with a hammer 3 and a tensioned string 4. Suspended above the action 2 is a mute rail 5 which rotates around a pivot point 6 to place an absorbent material 7 between the hammer 3 and string 4. This type of mute rail reduces the piano volume to a level of sound calculated to avoid disruption of neighboring environments such as apartments, practice rooms, etc.

Other conventional (prior art) systems, such as the mute rail system 20 shown in FIG. 2, are often excessively flexible due to the limited number of anchor points that are available for a rail 22 mounted within the interior of the action space. These systems can exhibit excessive vibratory motion when struck by groups of hammers at high velocities. The excessive vibratory motion dampens rebound forces of the hammers after impact, thereby changing the tactile sensation of the rebound forces as felt in the keys by the musician. The distance between the mute rail system 20 and the strings is also generally greater due to deflection of the mute rail system 20, than otherwise, resulting in a comprise of the original, acoustical mode adjustment of the action.

Conventional mute rail systems often require ample space within the confined action cavity, in order to achieve their full rotation. The extra space is achieved along a vertical, horizontal, or depth axis, creating challenges for installation, structural stability, and long term performance consistency.

SUMMARY

In one aspect, a piano, playable in an acoustic mode and a silent mode, includes a series of keys, a series of key actions, and a series of rotatable hammers. Each key action is actuated by depression of a corresponding key. Each hammer defines a forward throw direction and has a corresponding string. The hammers are driven by corresponding key actions transferring forces from corresponding keys. The piano includes a hammer stopper system that has a blocking rail slidably disposed forward of the hammers. A linear actuator moves the blocking rail along a substantially linear path between a first position, allowing unobstructed movement of the hammers, and a second position blocking at least one hammer from striking its corresponding string. The linear actuator moves the blocking rail to the first position for acoustic play and to the second position for silent play.

Implementations of this aspect of the disclosure may include one or more of the following features. In some implementations, the linear actuator includes an actuator rail rotatably disposed behind the hammers and at least one linkage assembly coupled to the actuator rail and the blocking rail for moving the blocking rail between the first position, allowing unobstructed movement of hammers of the piano, and the second position blocking at least one hammer from striking a corresponding string. The actuator rail is rotatable between a first position and a second position. In some examples, the linkage assembly includes a first link attached to the actuator rail and a second link pivotally coupled to the first link and to the blocking rail. In some implementations, the linear actuator includes at least one linear guide guiding movement of the blocking rail and an actuator rail rotatably disposed behind the hammers. The actuator rail is rotatable among a first position and a second position. At least one leash attaches the actuator rail to the blocking rail. The leash is arranged to translate rotation of the actuator rail to the blocking rail for moving the blocking rail between its first and second positions. The linear guide may include a telescoping guide having first and second ends. The first end of the telescoping guide is rotatably attached to the actuator rail, and the second end is attached to the blocking rail. Rotation of the actuator rail from its first position to its second position moves the attached leash about the actuator rail, pulling the blocking rail towards the actuator rail. In some examples, the leash passes between the blocking rail and the actuator rail through a passageway defined through the telescoping guide. In some implementations, the leash is a strap or a cord having several strands braided, twisted, or woven together.

In some implementations, the linear actuator includes first and second counteracting rail actuators. The first rail actuator moves the blocking rail to its first position, and the second rail actuator moves the blocking rail to its second position. A spring may be used to bias the blocking rail toward its first position. In other implementations, the linear actuator is a solenoid or a pneumatic actuator (e.g. with a spring actuated return stroke).

In another aspect, a piano, playable in an acoustic mode and a silent mode, includes a series of keys, a series of key actions, and a series of rotatable hammers. Each key action is actuated by depression of a corresponding key. Each hammer defines a forward throw direction and has a corresponding string. The hammers are driven by corresponding key actions transferring forces from corresponding keys. An actuator rail is rotatably disposed behind the hammers and is rotatable among a first position and a second position. At least one linear guide is rotatably attached over the actuator rail. A blocking rail is disposed forward of the hammers and is attached to the linear guide for moving along a substantially linear path among a first position, allowing unobstructed movement of the hammers, and a second position blocking at least one hammer from striking its corresponding string. At least one leash attaches the actuator rail to the blocking rail. The leash is arranged to translate rotation of the actuator rail to the blocking rail for moving the blocking rail between its first and second positions. The actuator rail is rotated to its first position for acoustic play and its second position for silent play.

Implementations of this aspect of the disclosure may include one or more of the following features. In some implementations, the linear guide includes a telescoping guide having first and second ends. The first end of the telescoping guide is rotatably attached to the actuator rail, and the second end is attached to the blocking rail. Rotation of the actuator rail from its first position to its second position moves the attached leash about the actuator rail, pulling the blocking rail towards the actuator rail. A spring may be used to bias the blocking rail toward its first position. In some examples, the leash passes between the blocking rail and the actuator rail through a passageway defined through the telescoping guide. In some implementations, the leash is a strap or a cord having several strands braided, twisted, or woven together.

In some implementations, the piano includes a rail rotator configured to rotate the actuator rail between its first and second positions. In some examples, the rail rotator includes a lever attached to the actuator rail and a link attaching the lever to a pedal of the piano. Actuation of the piano pedal toggles the actuator rail among the first and second positions. In other examples, the rail rotator includes at least one solenoid driving a linkage attached to the actuator rail, or a motor coupled to the actuator rail.

In yet another aspect, a piano, playable in an acoustic mode and a silent mode, includes a series of keys, a series of key actions, and a series of rotatable hammers. Each key action is actuated by depression of a corresponding key. Each hammer defines a forward throw direction and has a corresponding string. The hammers are driven by corresponding key actions transferring forces from corresponding keys. The piano includes a hammer stopper system which includes an actuator rail rotatably disposed behind the hammers and a blocking rail rotatably disposed forward of the hammers. The actuator rail and the blocking rail are each rotatable among a first position and a second position. One or more leashes are secured to the actuator rail. Each leash is arranged to translate rotation of the actuator rail to the blocking rail. The blocking rail stops at least one hammer from striking a corresponding string when the blocking rail is rotated from the first position to the second position. The actuator rail is rotated to its first position for acoustic play and its second position for silent play.

Implementations of this aspect of the disclosure may include one or more of the following features. In some implementations, the leash has first and second ends both secured to the actuator rail with the leash looping around the blocking rail. In other examples, the leash has first and second ends, where the first end of the leash is secured to the actuator rail and the second end of the leash is secured to the blocking rail. The leash may be a cord having several strands braided, twisted, or woven together. The piano may include at least one leash adjustment screw disposed on the actuator rail and configured to adjust a length of the associated leash.

The piano includes a rail rotator configured to rotate the actuator rail between its first and second positions. In some examples, the rail rotator includes a lever attached to the actuator rail and a link attaching the lever to a pedal of the piano. Actuation of the piano pedal toggles the actuator rail among the first and second positions. In other examples, the rail rotator includes at least one solenoid driving a linkage attached to the actuator rail, or a motor coupled to the actuator rail.

Implementations of the above aspects of the disclosure may include one or more of the following features. The piano, in some examples, includes a mode selection switch in communication with the linear actuator and controlling movement of the blocking rail among the first and second positions. A pedal of the piano engages the mode selection switch.

In some implementations, the piano includes a controller in communication with the linear actuator for controlling switching among the acoustic play mode and the silent play mode. The controller includes a controller housing, circuitry carried by the controller housing, and a display in communication with the circuitry. The controller may also include a disk drive. The controller housing is slidably attached below a keyboard portion of the piano, such that the controller housing slides among a stowed position and a deployed position. In some examples, the display is a touch screen.

In another aspect, a hammer stopper system for a piano includes a blocking rail, at least one linear guide attached to the blocking rail, an actuator rail rotatably coupled to the linear guide, and at least one leash attaching the actuator rail to the blocking rail. The actuator rail is rotatable among a first position and a second position. The leash is arranged to translate rotation of the actuator rail to the blocking rail for moving the blocking rail between a first position, allowing unobstructed movement of hammers of the piano, and a second position blocking at least one hammer from striking a corresponding string.

Implementations of this aspect of the disclosure may include one or more of the following features. In some implementations, the at least one linear guide includes a telescoping guide having first and second ends. The first end of the telescoping guide is rotatably attached to the actuator rail, the second end is attached to the blocking rail. Rotation of the actuator rail from its first position to its second position winds the attached leash about the actuator rail, pulling the blocking rail towards the actuator rail. In some examples, the leash passes between the blocking rail and the actuator rail through a passageway defined through the telescoping guide. A spring may bias the blocking rail toward its first position. In some implementations, the leash is a strap or a cord having several strands braided, twisted, or woven together.

In another aspect, a hammer stopper system for a piano including a blocking rail, and a linear actuator configured to move the blocking rail between a first position, allowing unobstructed movement of piano hammers, and a second position blocking at least one hammer from striking its corresponding string. The linear actuator including an actuator rail being rotatable between a first position and a second position, and at least one linkage assembly coupled to the actuator rail and the blocking rail for moving the blocking rail between the first position, allowing unobstructed movement of piano hammers, and the second position blocking at least one hammer from striking a corresponding string. The linear actuator moves the blocking rail to the first position for acoustic play and to the second position for silent play. In some implementations, the linkage assembly includes a first link attached to the actuator rail and a second link pivotally coupled to the first link and to the blocking rail. In some examples, the hammer stopper system includes a spring that biases the blocking rail toward its first position.

The details of one or more implementations of the disclosure are set forth in the accompanying drawings and the description below. Other features, objects, and advantages will be apparent from the description and drawings, and from the claims.

DESCRIPTION OF DRAWINGS

Like reference symbols in the various drawings indicate like elements.

DETAILED DESCRIPTION

The present disclosure provides a hammer stopper system that may be incorporated in upright and horizontal pianos. In some configurations, as described below, the hammer stopper system can be retrofit into existing pianos, and/or removed for ease of maintenance.

Figure 1:
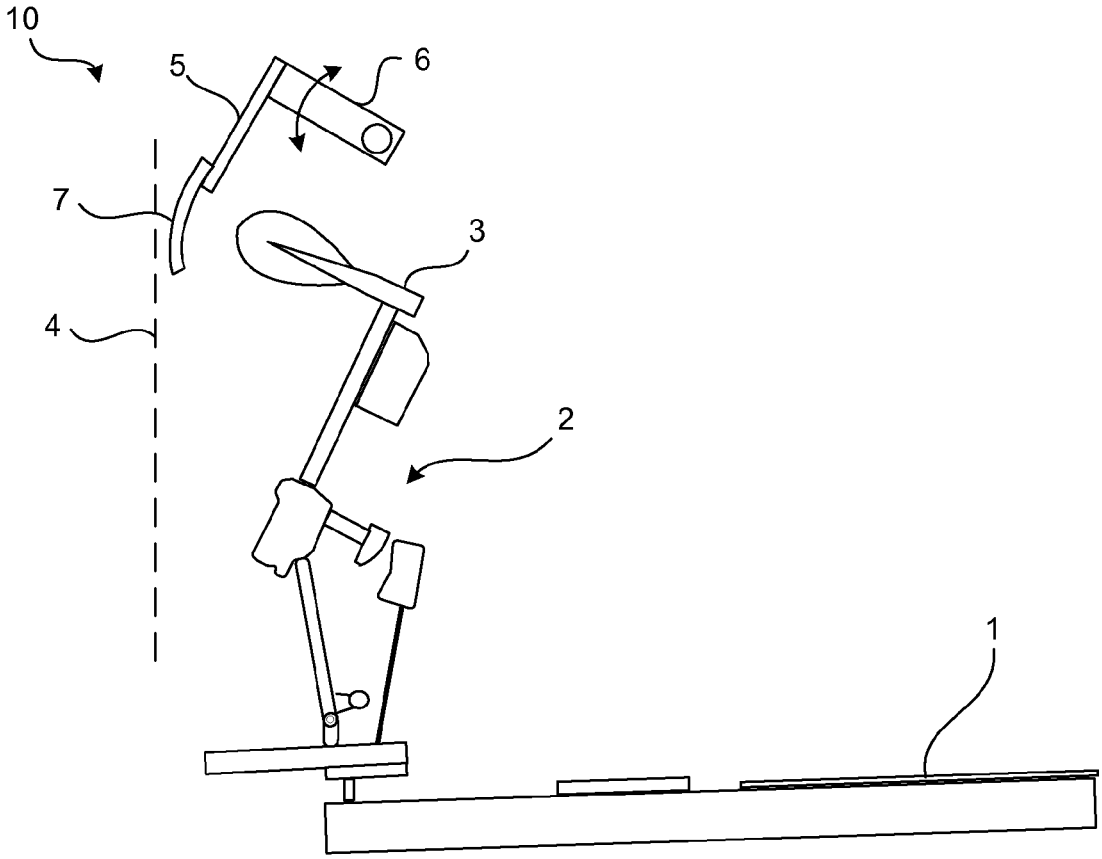
PRIOR ART FIG. 1
FIG. 1 is a side view of a prior art hammer stopper assembly.
Figure 2:
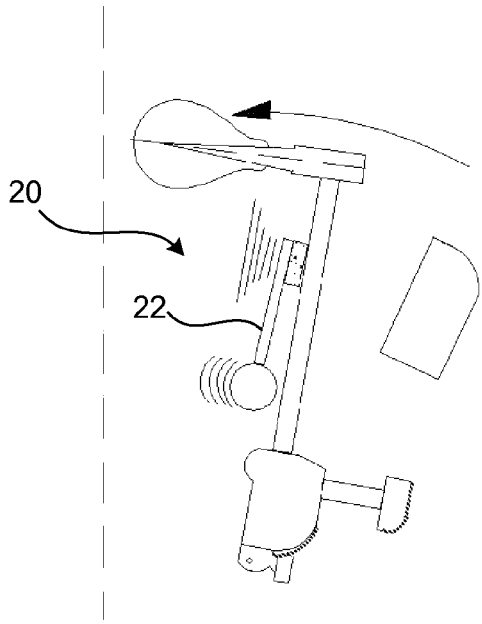
PRIOR ART FIG. 2
FIG. 2 is a side view of a prior art hammer stopper assembly.
Figure 3:
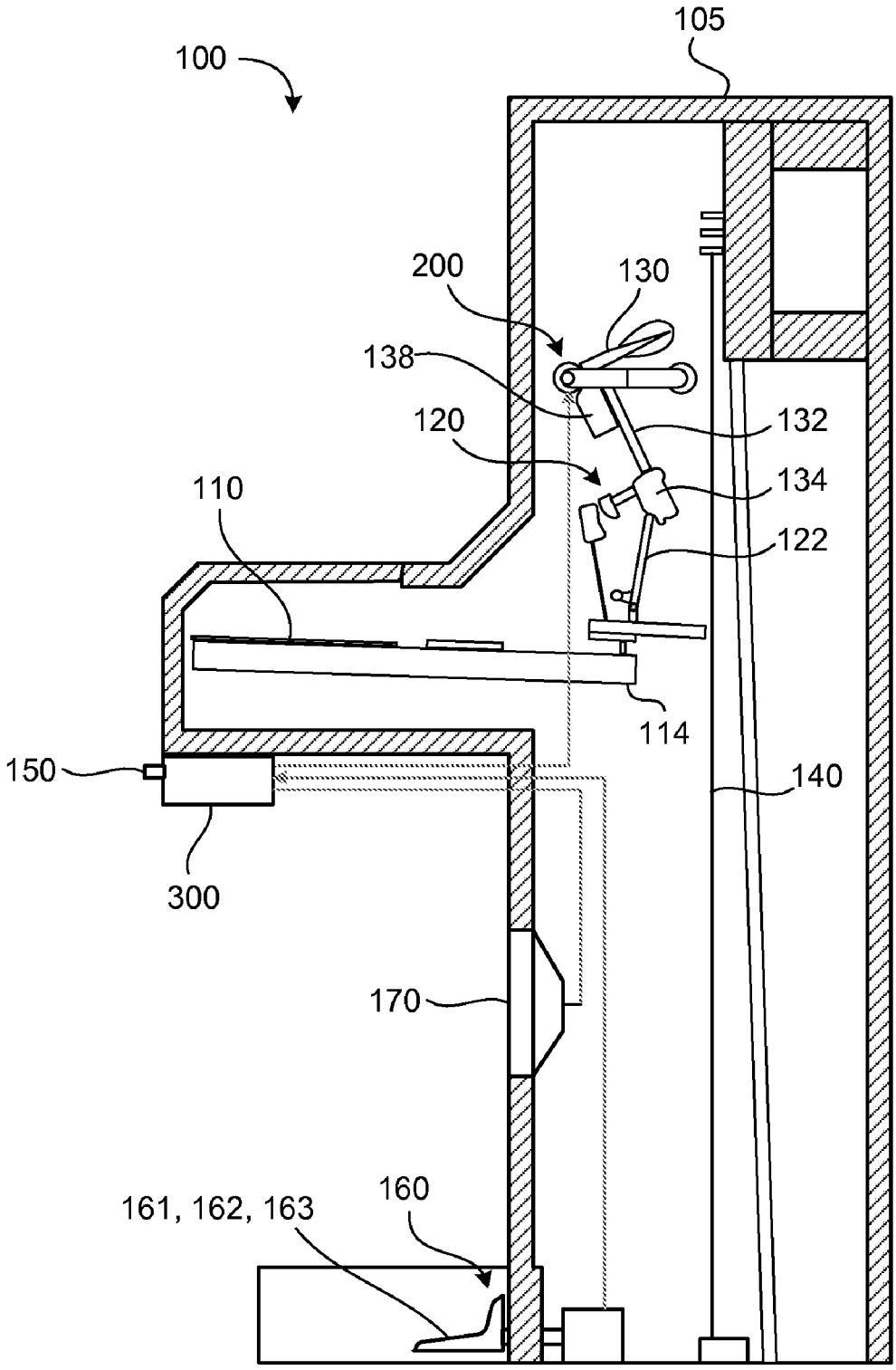
FIG. 3 is a section view of an upright piano with a hammer stopper system.
Figure 4:
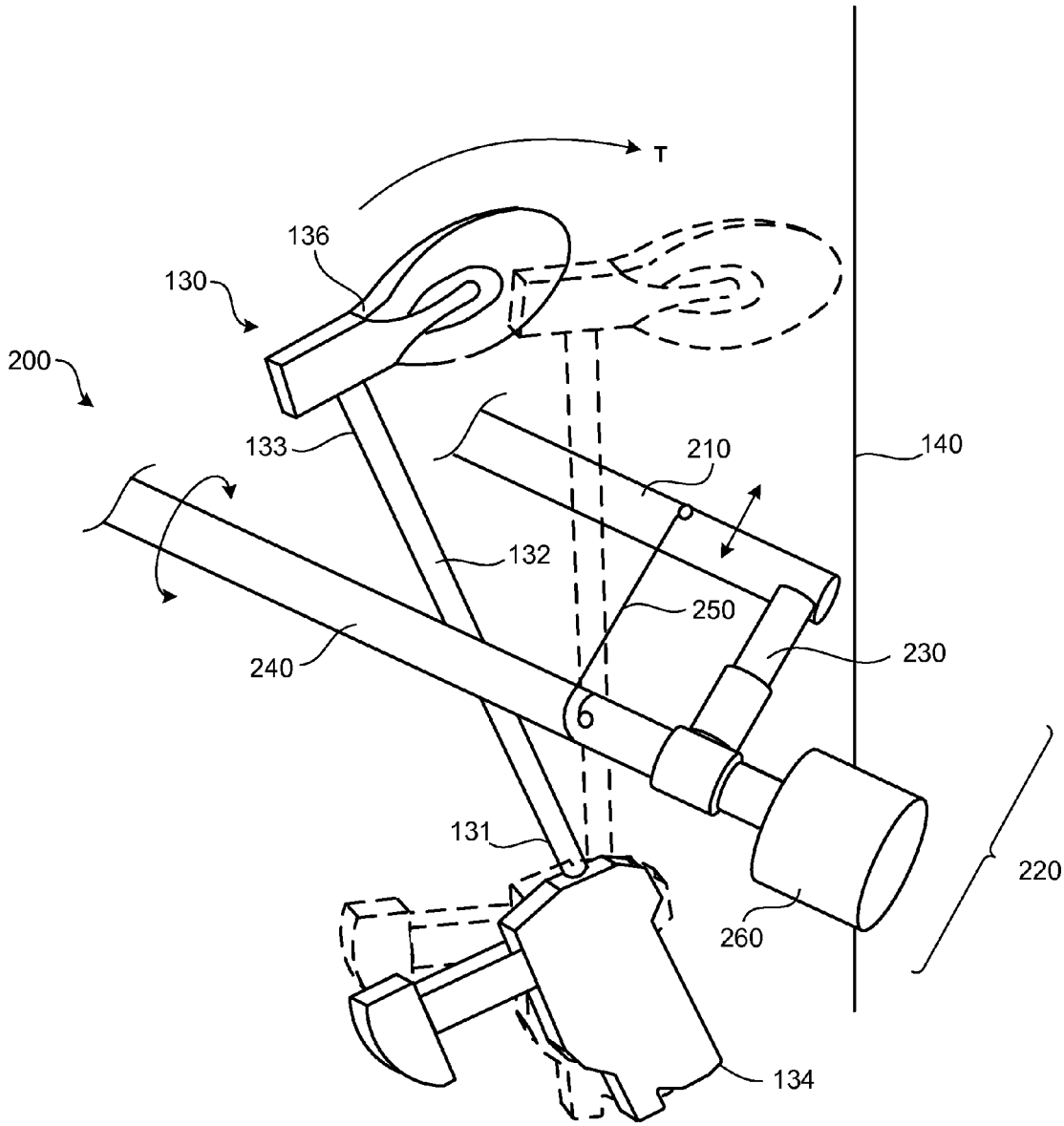
FIG. 4 is a perspective view of a hammer stopper system having a blocking rail and a linear actuator.

Referring to FIGS. 3-4, a piano 100, playable selectively in an acoustic mode and a silent mode, includes a series of keys 110 and corresponding key actions 120 linked to rear ends 114 of the keys 110. Each key action 120 is actuated by depressing a corresponding key 110. A series of rotatable hammers 130, each defining a forward throw direction T, are driven by corresponding key actions 120, which transfer forces from corresponding pressed keys 110. Each hammer 130 is aligned to strike a corresponding string 140, upon being thrown.

Each hammer 130 includes a hammer shank 132, a butt 134 attached to a first end 131 of the shank 132, and a hammer head 136 attached to an opposite, second end 133 of the shank 132. A depressed or actuated key 110 causes a jack 122 of the associated key action 120 to kick the butt 134 of the hammer 130. When the jack 122 kicks the butt 134, the butt 134 and the hammer shank 132 are driven for rotation toward the associated strings 140. The hammer head 136 strikes the string(s) 140, producing an acoustic sound. When the keys 110 are in a rest position (e.g. when a player is not pressing the keys 110), the hammers 130 remain in home positions, resting on a hammer resting rail 138.

Figure 5:
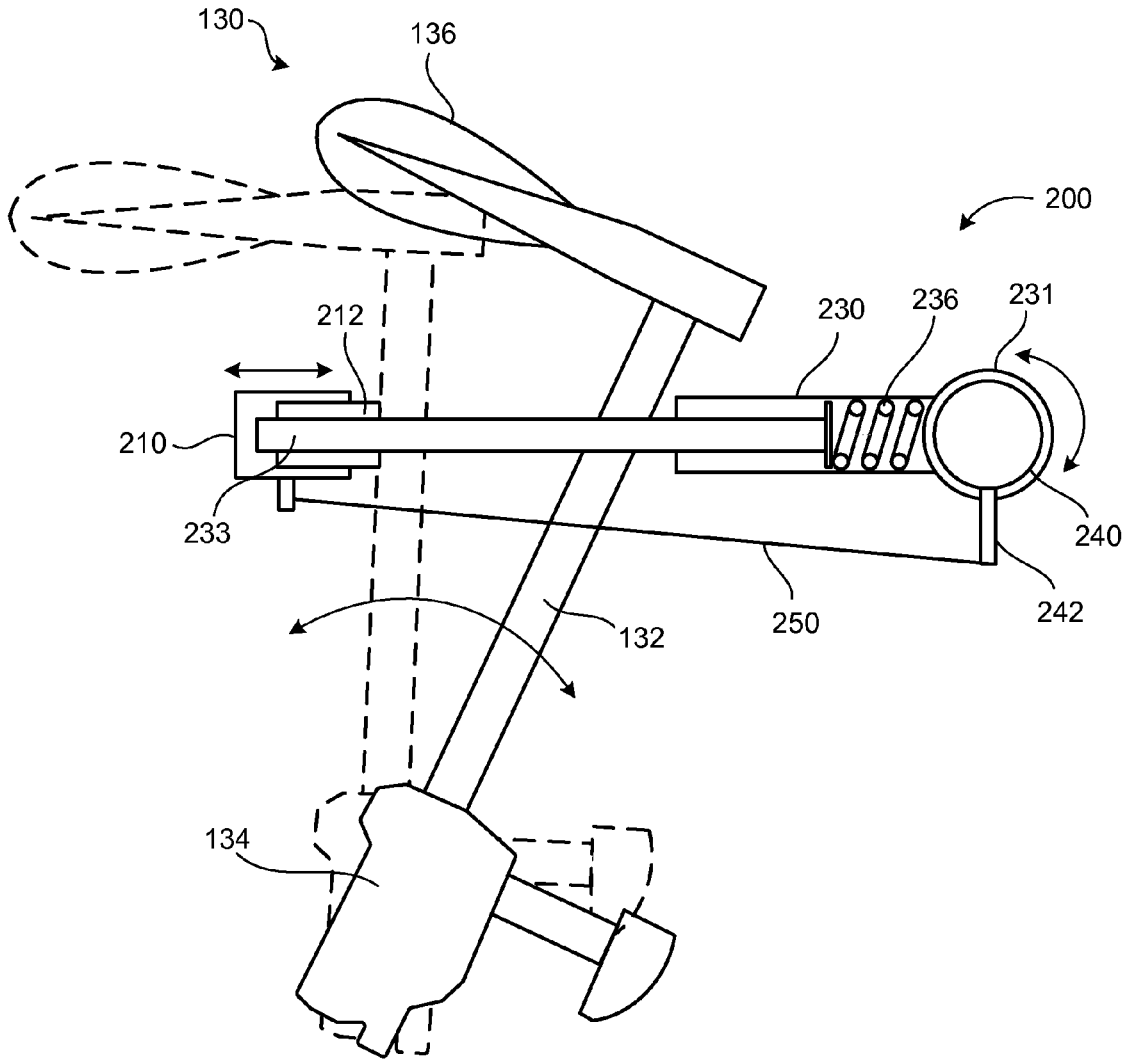
FIG. 5 is a side section view of a hammer stopper system having an actuator rail, a telescoping guide attached to a blocking rail, and a leash translating movement of the actuator rail to the blocking rail.

A hammer stopper system 200, an example of which is shown in FIGS. 4 and 5, includes a blocking rail 210 slidably disposed forward of the hammers 130 and a linear actuator 220 configured to move the blocking rail 210 along a substantially linear path between a first position, allowing unobstructed movement of the hammers 130, and a second position blocking at least one hammer 130 from striking its corresponding string 140. The linear actuator 220 moves the blocking rail 210 to the first position for acoustic play and to the second position for silent play. The blocking rail 210 may include a hammer cushion 212 positioned to receive and absorb the impact of a thrown hammer 130.

In some implementations, the linear actuator includes at least one linear guide 230 guiding movement of the blocking rail 210, and an actuator rail 240 rotatably disposed behind the hammers 130 and substantially perpendicular to the throw direction T of the hammers 130. The actuator rail 240 is rotatable among a first position and a second position. At least one leash 250 attaches the actuator rail 240 to the blocking rail 210. The leash 250 is arranged to translate rotation of the actuator rail 240 to the blocking rail 210 for moving the blocking rail 210 between its first and second positions. Multiple actuator rails 240 may be disposed in the piano 100, where each actuator rail 240 stops only a certain number of hammers 130 of piano 100. In some implementations, the actuator rail 240 is located proximate the hammer resting rail 138. In one example, the actuator rail 240 is located above the hammer resting rail 138 and in the vicinity of the resting hammer heads 136. The actuator rail 240 is rotated among a first position for acoustic play and at least one second position for silent play by a rotator or actuator 260 coupled to the actuator rail 240. The rotator 260 may be a linear or rotary solenoid, stepper or servo motor, thumb lever, linked piano pedal, or other suitable means. In some implementations, the rotator 260 is bi-directionally rotatable. In one example, the rotator 260 is an ultrasonic motor, which is capable of maintaining the actuator rail 240 at any rotational position without a current to the ultrasonic motor and quickly rotating without backlash.

Figure 6:
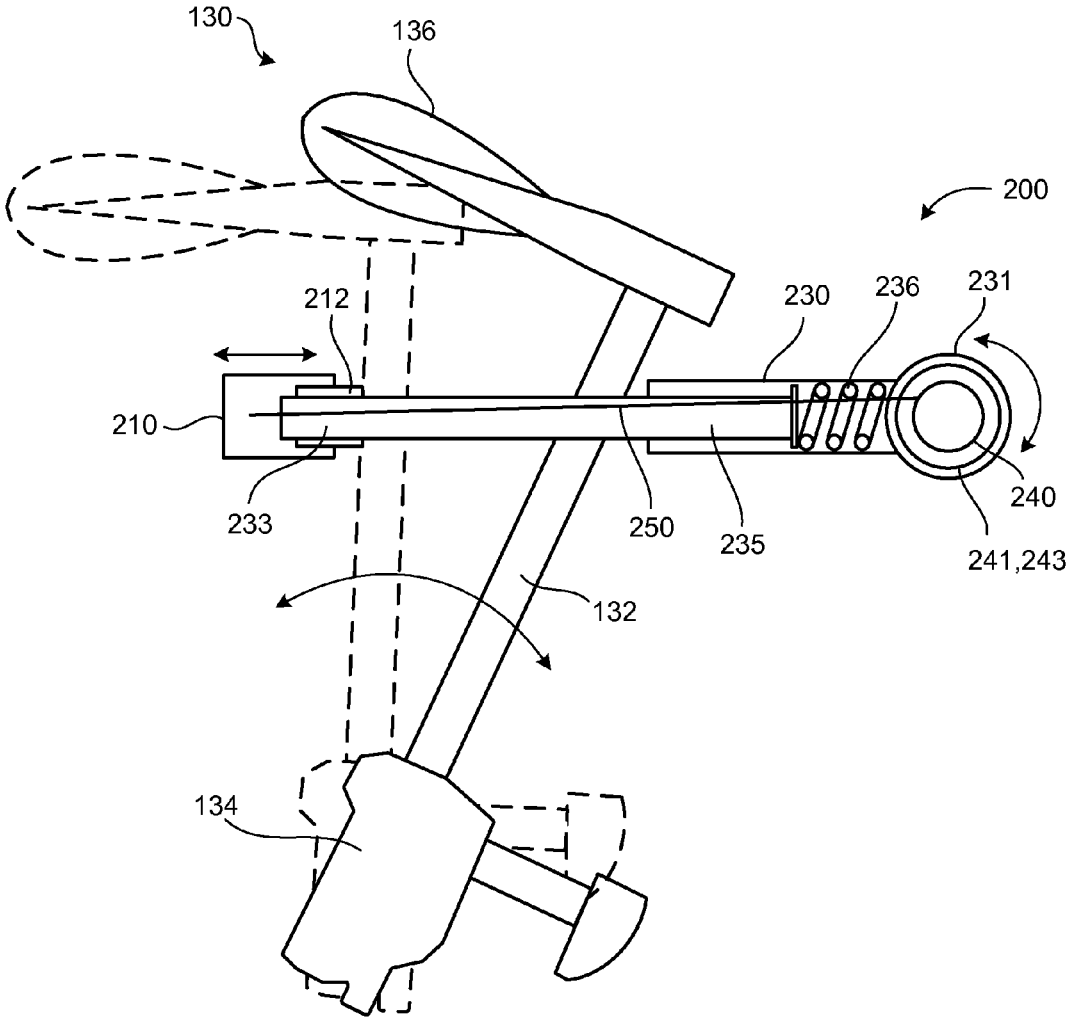
FIG. 6 is a side section view of a hammer stopper system having an actuator rail, a telescoping guide, and a leash connecting the actuator rail to the blocking rail and passing through a passageway of the guide.

In the examples illustrated in FIGS. 4-6, the linear guide 230 is a telescoping guide having first and second ends 231 and 233, respectively. The first end 231 is rotatably attached to the actuator rail 240, and the second end 233 is attached to the blocking rail 210. In the example illustrated in FIG. 4, rotation of the actuator rail 240 from its first position to its second position winds the attached leash 250 about the actuator rail 240, pulling the blocking rail 210 toward the actuator rail 240. In the example illustrated in FIG. 5, the leash 250 is coupled to a leash arm 242 attached the actuator rail 240.

Rotation of the actuator rail 240 from its first position to its second position causes rotation of the leash arm 242, which pulls on leash 250 to pull the blocking rail 210 toward the actuator rail 240. The telescoping guide 230 is biased by a spring 236 to move the blocking rail 210 toward its first position, which allows unobstructed movement of the hammer 130. In the example illustrated in FIG. 6, the leash 250 passes between the blocking rail 210 and the actuator rail 240 through a passageway 235 defined through the telescoping guide 230. Rotation of the actuator rail 240 from its first position to its second position winds the attached leash 250 about the actuator rail 240, pulling the blocking rail 210 towards the actuator rail 240.

Figure 7:
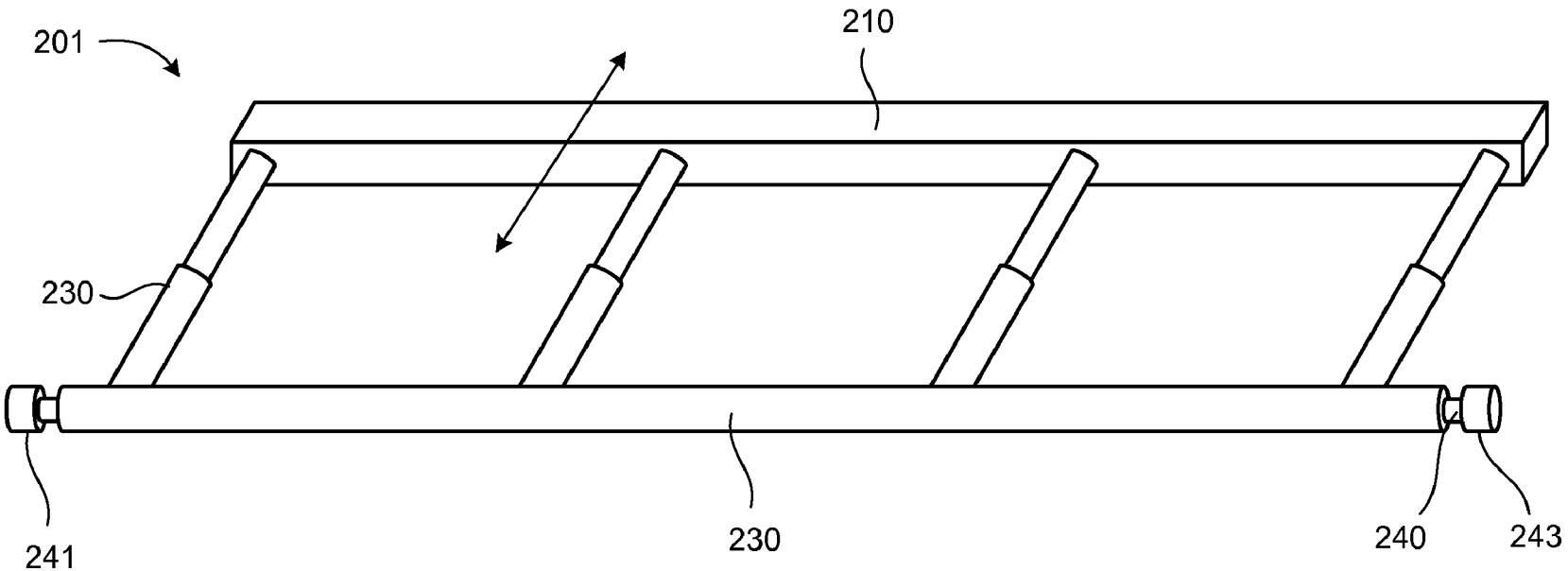
FIG. 7 is a perspective view of the hammer stopper system shown in FIG. 6.

The hammer stopper system 200 can be configured to be removably installed in both upright and horizontal pianos 100. In the example illustrated in FIGS. 6-7, a hammer stopper system 201 includes a blocking rail 210 attached to a linear guide 230, which is rotatably coupled to an actuator rail 240. A leash 250 connects the actuator rail 240 to the blocking 210 and translates movement of the actuator rail 240 to the blocking 210. The actuator rail 240 has first and second ends 241 and 243, respectively, which are configured to be received in corresponding receiver brackets (not shown) mounted to a piano case 105 (see FIG. 3). The first and second ends 241, 243 of the actuator rail 240 are allowed to rotate in their respective receiver brackets. In the example shown, the linear guide 230 is a telescoping guide having first and second ends 231 and 233, respectively. The first end 231 is rotatably attached to the actuator rail 240, and the second end 233 is attached to the blocking rail 210. The leash 250 passes between the blocking rail 210 and the actuator rail 240 through a passageway 235 defined through the telescoping guide 230. Rotation of the actuator rail 240 from its first position to its second position winds the attached leash 250 about the actuator rail 240, pulling the blocking rail 210 towards the actuator rail 240.

Figure 8:
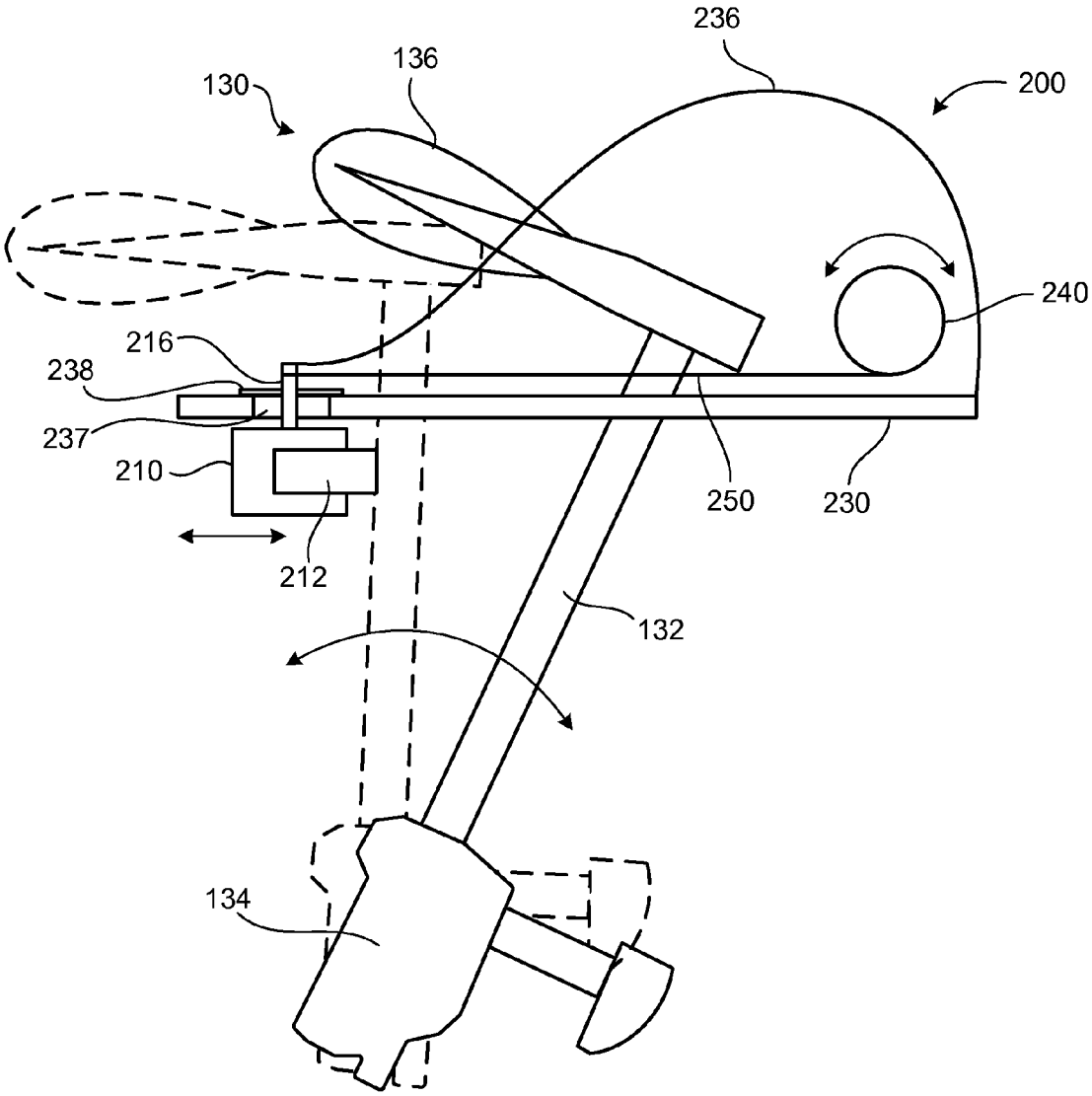
FIG. 8 is a side view of a hammer stopper system having an actuator rail, a slotted guide supporting and guiding a blocking rail, a leash connecting the actuator rail to the blocking rail, and a spring biasing the blocking rail away from the actuator rail.

Referring to FIG. 8, in some implementations, the linear guide 230 of the hammer stopper system 200 is an elongated support defining a slot 237. A projection 216 (e.g. a bolt) extending from the blocking rail 210 passes through the slot 237 and is secured in the slot 237 by an attached retaining device 238 (e.g. a washer and threaded nut). The blocking rail 210 slides along the slot 237 between its first and second positions. The leash 250 is shown attached to the actuator rail 240 and the blocking rail projection 216; however, the leash 250 may be attached directly to the blocking rail 210, instead of its projection 216. A spring 236 configured as a leaf spring that elastically deforms is attached to the actuator rail 240 and the blocking rail projection 216; however, the spring 236 may be attached directly to the blocking rail 210, instead of its projection 216. The spring 236 biases the blocking rail 210 toward its first position.

One or more leashes 220 are secured to the actuator rail 240. In some implementations, the leash 250 has first and second ends 251 and 253, respectively, both secured to the actuator rail 240, and loops around the blocking rail 210. In other implementations, the first end 221 of the leash 250 is secured to the actuator rail 240 and the opposite, second end 223 is secured to the blocking rail 210. In one example, the leash 250 is a cord or strap having several strands braided, twisted, or woven together. In another example, the leash 250 is a single mono-filament. In yet another example, the leash 250 is a molded strap.

Figure 9:
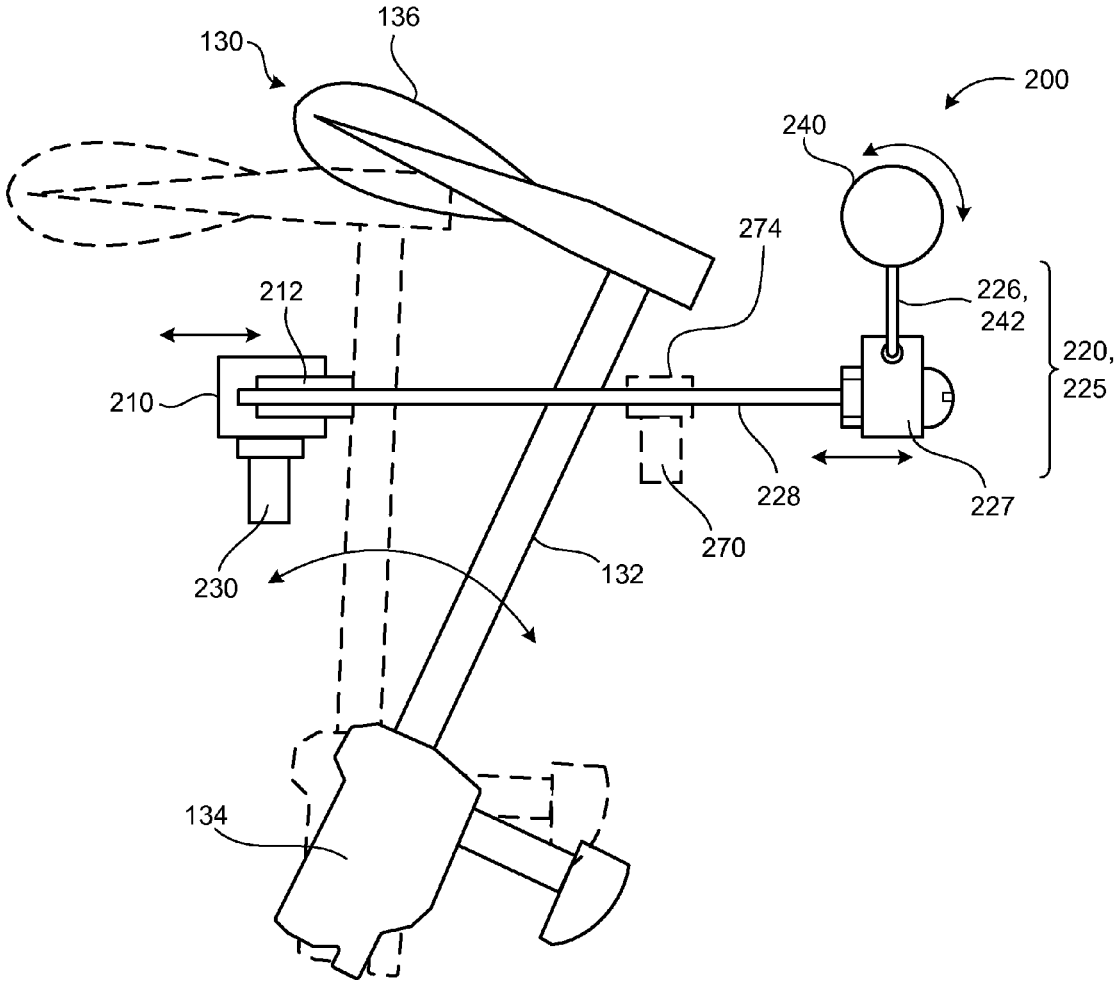
FIG. 9 is a side view of a hammer stopper system having an actuator rail connected to a blocking rail by a joint coupled to a guide rail.

In the example illustrated in FIG. 9, the linear guide 230 is positioned substantially below the blocking rail 210 and is configured to support the blocking rail 210 as it slides thereover between its first and second positions. The linear actuator 220 may include at least one linkage assembly 225 coupled to the actuator rail 240 and the blocking rail 210 for moving the blocking rail 210 between its first position, allowing unobstructed movement of hammers 130, and the second position blocking at least one hammer 130 from striking a corresponding string 140. The linkage assembly 225 includes a first link 226 attached to the actuator rail 210 and a second link 228 pivotally coupled to the first link 226 and to the blocking rail 210. In some examples, the piano 100 includes a slide guide 270 for supporting the second link 228 (e.g., making the linear guide 230 optional). The slide guide 270 includes a sliding carriage or slider 274 sliding over the second link 228. In the example shown, the second link 228 is connected to the blocking rail 210 and supported by the sliding carriage or slider 274. The guide rail 228 may also be connected to a joint 227 (e.g. a universal joint) that is coupled to the first link 226 (e.g., leash arm 242) extending from the actuator rail 240. Rotation of the actuator rail 240 from its first position to its second position causes rotation of the first link 226, which pulls the second link 228 and the attached blocking rail 210 toward the actuator rail 240. The first link 226 may be telescopically configured for cases that include the slide guide 270, to accommodate the restricted movement along a single axis. In other examples, the second link 228 is stationary and supports the sliding carriage or slider 274, which connects the blocking rail 210 to the joint 227, which is coupled to the first link 226.

Figure 10:
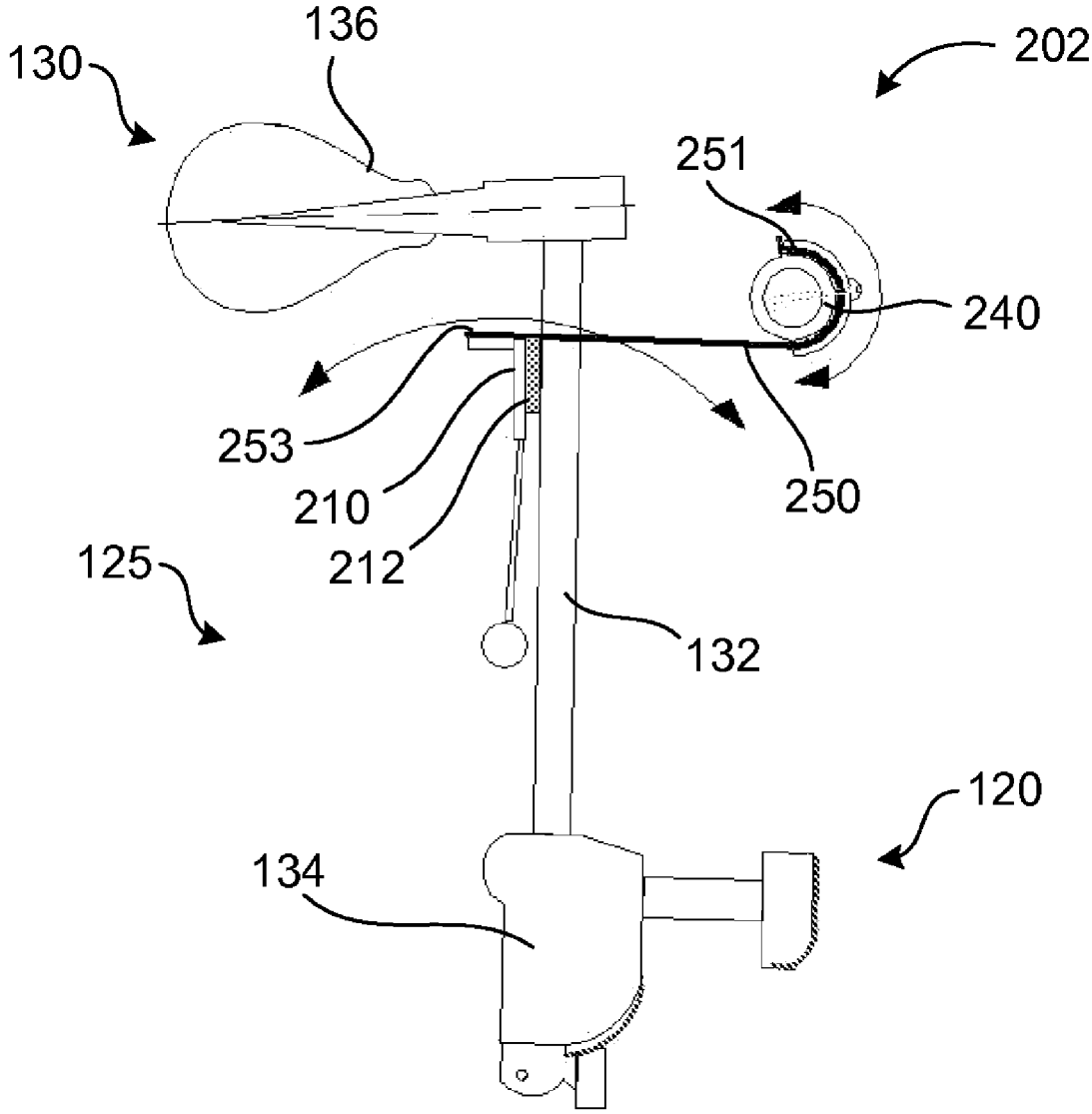
FIG. 10 is a side view of a hammer stopper system having an actuator rail connected to a blocking rail by a leash.

Referring to FIG. 10, a hammer stopper system 202 includes at least one actuator rail 240 rotatably disposed behind the hammers 130 and substantially perpendicular to the throw direction T of the hammers 130. Multiple actuator rails 240 and corresponding blocking rails 210 may be disposed in the piano 100, where each actuator rail 240 actuates its corresponding blocking rail 210 to stop only a certain number of corresponding hammers 130 of piano 100. In some implementations, the actuator rail 240 is located proximate the hammer resting rail 138. In one example, the actuator rail 240 is located above the hammer resting rail 138 and in the vicinity of the resting hammer heads 136. Similar to the hammer stopper assembly 200 described above, the actuator rail 240 is rotated among a first position for acoustic play and at least one second position for silent or muted play by an actuator 260 coupled to the actuator rail 240. At least one leash 250 is secured to the actuator rail 240 and influences movement of a blocking rail 210 pivotally mounted within an interior action space 125 and configured to temporarily block one or more hammers 130. The blocking rail 210 may include a hammer cushion 212 positioned to receive and absorb the impact of a thrown hammer 130. The leash 250 can be strategically arranged or located at a place where the blocking rail 210 is most prone to flexing or deformation, such as midpoints between conventional action brackets 126 (see FIG. 11). The leash 250 is arranged to pivot the blocking rail 210 among a non-blocking position and one or more blocking positions. In some implementations, the leash 250 is a line having first and second ends 251 and 253, respectively, both secured to the actuator rail 240. The leash 250 loops around the blocking rail 210 (see FIG. 12). In other implementations, the first end 251 of the leash 250 is secured to the actuator rail 240 and the opposite, second end 253 is secured to the blocking rail 210, as shown.

Figure 11:
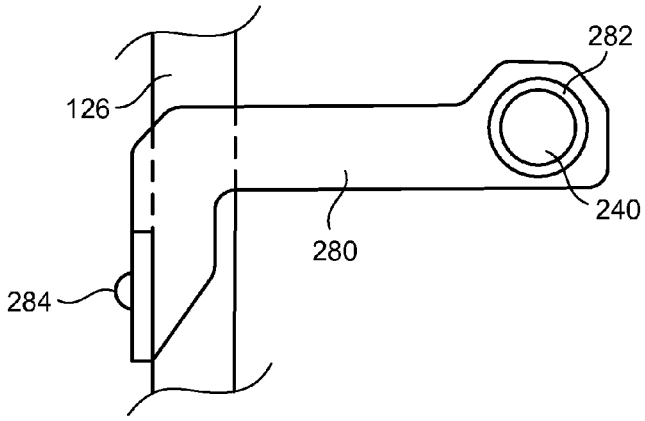
FIG. 11 is a side view of an actuator rail bracket.
Figure 12:
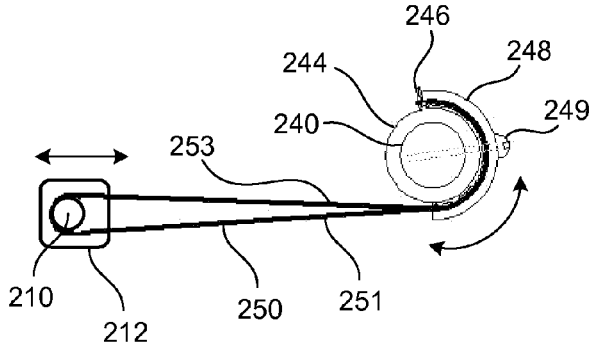
FIG. 12 is a side view of an actuator rail and an associated leash looped around a blocking rail.

Referring to FIGS. 11-12, in some implementations, the actuator rail 240 is rotatably supported by a rail bracket 280 via a bushing 282. The rail bracket 280 is connected to the piano action bracket 126, e.g., by both a screw 284 and/or an action thumbscrew (not shown). The rail bracket 280 may be fastened to a front portion, a rear portion (as shown), or a side portion of the piano action bracket 126. In some implementations, the actuator rail 240 is surrounded by a cushion or damper 244, such as an elastic material (e.g. elastic tube) configured to provide dampening for the leashes 250 against impacts. In some examples, the cushion 244 is formed of one or more sheets of felt or urethane and bonded to the actuator rail 240. The cushion 244 is durable against hammer strike impacts transmitted through the leashes 250.

The leash 250 is secured to a flange 246, in some examples, which aids assembly/service by holding the leash 250 in a correct position and prevents leash slippage during piano use. In some implementations, the actuator rail 240 includes a leash adjustment screw 246 attached to an associated leash 250. Adjustment of the leash adjustment screw 246 varies a leash length, which varies a stopping position of the associated blocking rail 210. Adjusting the hammer stopping position to be as close as possible to the strings 140 without touching the strings 140 minimizes degradation of piano key touch. In the example shown, an outer cap 248 disposed over the leash 250 and the actuator rail 240 stiffens the actuator rail 240 against impact forces and clamps the leash 250 in place by one or more screws 249 spaced at regular intervals along the actuator rail 240. In some implementations, leash servicing can also be done by sections, by moving an entire actuator rail 240. This can be done by inserting (or removing) shims between the action bracket 126 and the rail mounting bracket 280, thereby moving the entire actuator rail 240 toward or away from the hammers 130.

After a period of use, the leash(es) 250 may stretch, thereby potentially allowing the hammers 130 to strike the strings 140 during the silent play mode. Servicing the leash 250 entails loosening the outer cap 248, repositioning the leash 250 to the appropriate length, and re-securing the outer cap 248 to the actuator rail 240. If the actuator rail 240 includes a leash adjustment screw 246, the leash adjustment screw 246 is rotated to change the effective length of the associated leash 250.

Figure 13:
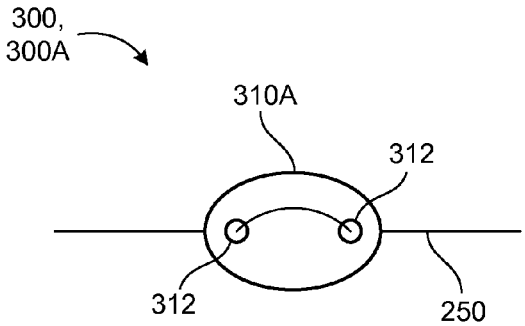
FIGS. 13-14 are top views of leash accessories.
Figure 14:
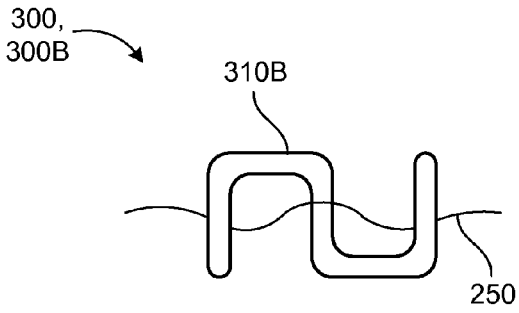

Another method of altering the leash length is by adding a length altering leash accessory 300, as illustrated in FIGS. 13-14. The leash accessory 300 attaches to the leash 250 and, while attached, shortens the leash length. One example of a leash accessory 300A includes a leash accessory body 310A (e.g. elliptical or circular shaped) defining two holes 312 through which the leash 250 passes. The effective leash length is shortened by creating a non-linearity in the leash 250. In another example, a leash accessory 300B includes a leash accessory body 310B defining a substantially S-shaped figure. The leash accessory 300B is clipped over the leash 250, which follows an S-shaped path around the leash accessory 300B, thereby effectively decreasing the leash length.

Figure 15:
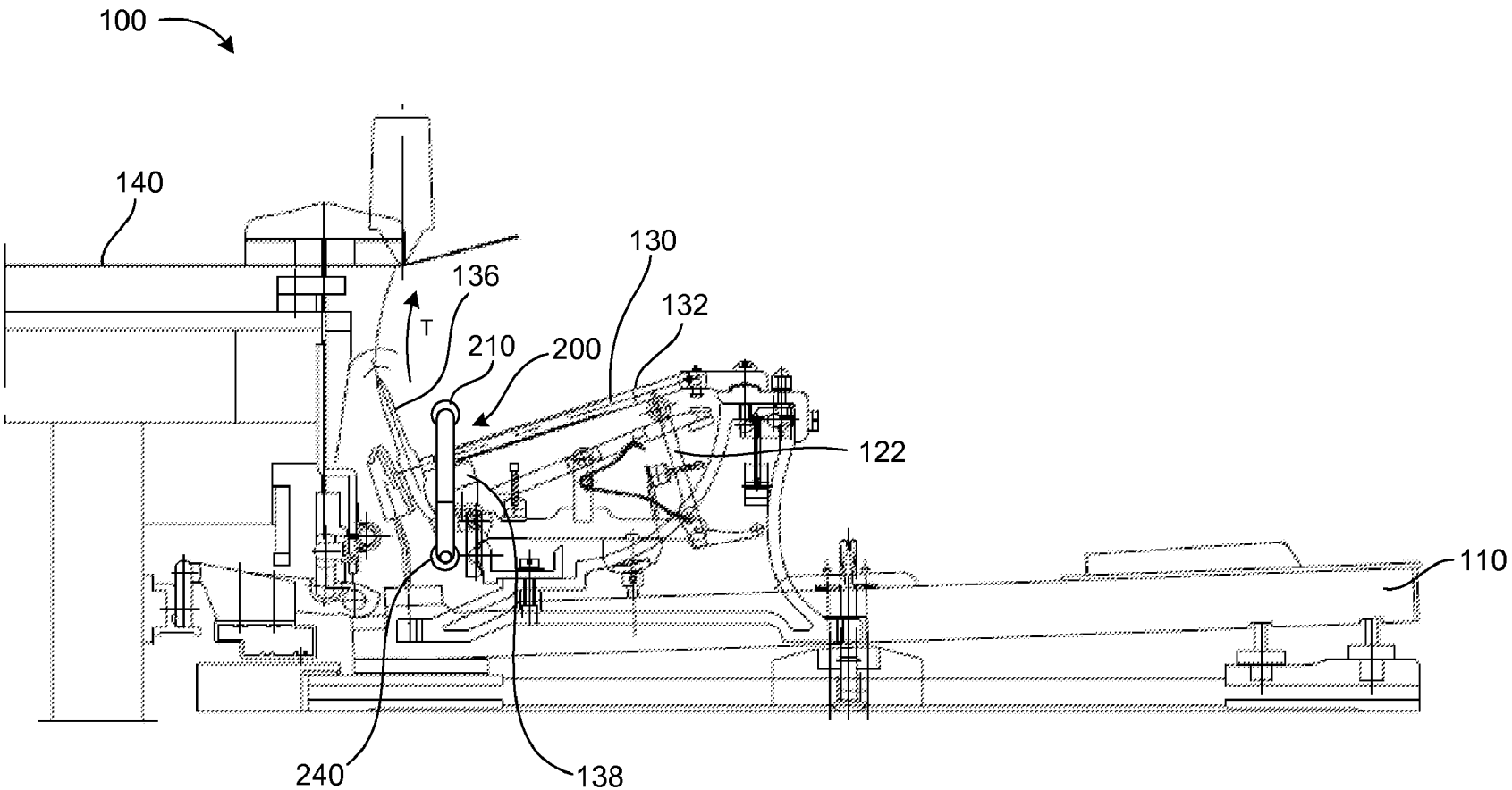
FIG. 15 is a side view of a hammer stopper system for a horizontal piano.

FIG. 15 illustrates an implementation of the hammer stopper system 200 on a horizontal (grand-style) piano 100. The hammer throw direction T is upward. The actuator rail 240 is located behind (e.g. below—from a viewer's perspective) the hammers 130 proximate the hammer head 136.

During piano play, the key actions 120 drive associated hammers 130 for rotation as the jack 122 kicks the hammer 130. The hammers 130 travel from resting positions on the hammer resting rail 138 toward strike positions at the associated strings 140. During the acoustic play mode, the actuator rail 240 is rotated to the first rail position, which unwinds the leash 250 from the actuate rail 250, thereby effectively lengthening the leash 250 and allowing the hammers 130 to strike the strings 140. During silent play mode, the actuator rail 240 is rotated to the second rail position, winding the leash 250 about the actuator rail 240 and effectively shortening the leash 250. The shortened leash 250 pulls the blocking rail 210 toward the actuator rail 240 to block and thereby prevent the hammers 130 from striking the strings 140.

In some implementations, the piano 100 includes a mode switch 150 in communication with the rail actuator or rotator 260. A user may toggle the mode switch 150 to alter the play mode between acoustic play and silent play, and the actuator rail 240 is rotated to the corresponding position of the play mode.

Figure 16:
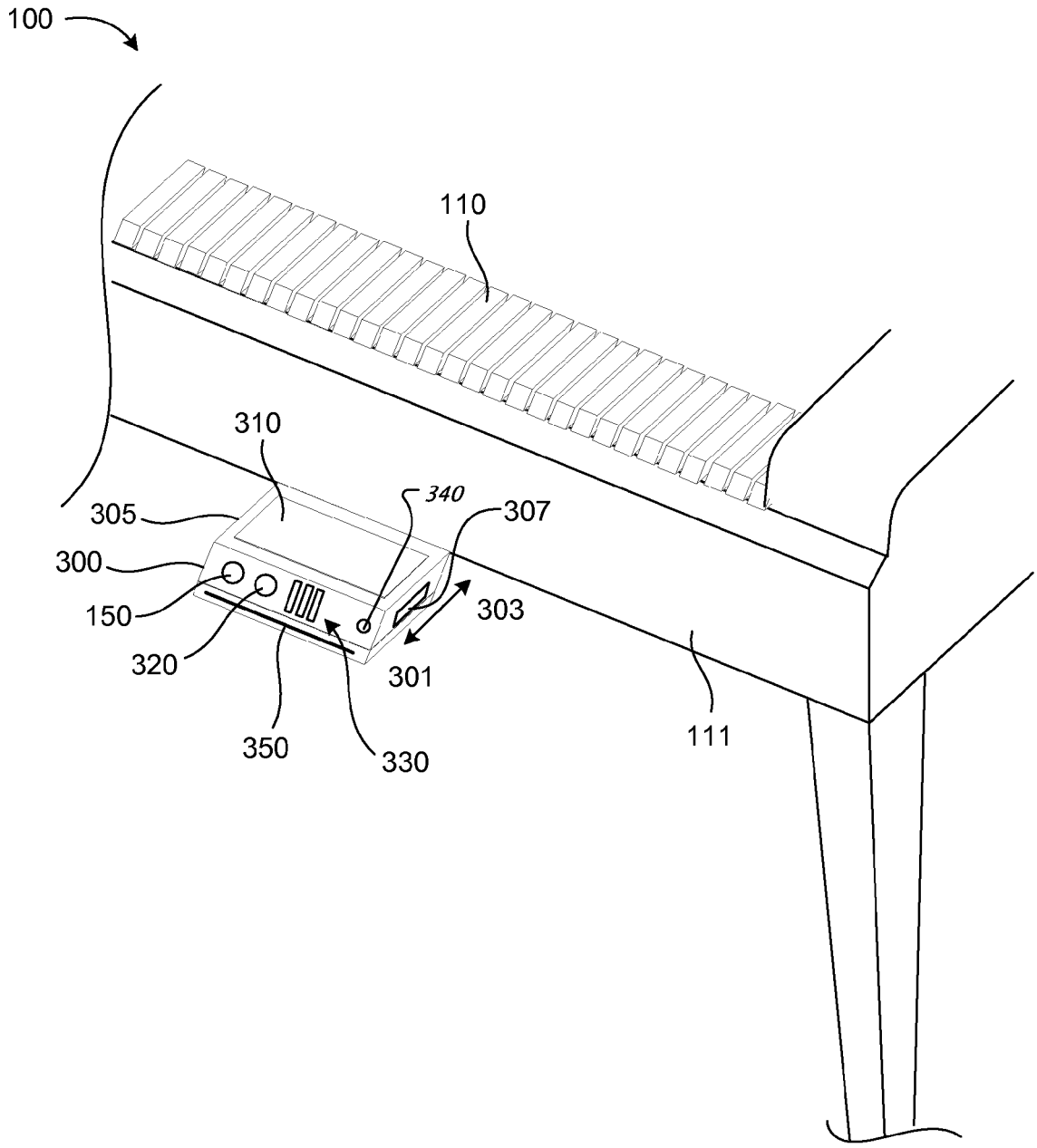
FIG. 16 is a perspective view of a controller unit on a piano.

Referring to FIGS. 3 and 16, in some implementations, the piano 100 includes a controller unit 300. The controller unit 300 includes a housing 305 which may house all circuitry 307 (e.g., circuit boards), or additional circuit boards associated with the piano may be housed elsewhere in the piano 100 (e.g. behind the key bed). The controller unit 300 is typically disposed below a keyboard portion 111 and slidable among first and second positions 301 and 303, respectively. A user has access to the controller unit 300 in the first position 301, and the controller unit 300 is stowed in the second position. The controller unit 300 is in communication with the rail actuator 260, a speaker 170, and, optionally, a pedal assembly 160. The controller unit 300 carries circuitry that controls switching between play modes (e.g. via the actuator or rotator 260), storing play information (e.g. MIDI files), electronic play calibration, tone adjustment, and trouble shooting, inter alia. In some examples, a user may switch between play modes via a switch 150 or other input device on the controller unit 300. In some examples, the controller unit 300 includes a display 310 (e.g. LCD display or touch screen) to communicate controlled information (e.g. play mode, piano voices, etc). If the display 310 is a touch screen, the user may provide desired control inputs via the display 310. The controller unit 300 may include the mode switch 150, a volume control knob 320, voice selection controls 330, and a headphone jack 350 configured to a head phone. Examples of information displayed by the display 310 include: descriptions of voices, commands, modes, and other selections available to the user; graphs of sound waveforms; and flashing prompts signaling various events. The controller unit 300 may include light emitting diodes (LED) indicating button, switch, and or mode selections. In some examples, the controller unit 300 defines ports for MIDI input, audio input, supplemental power, universal serial bus, ethernet, and/or phone connections. In one example, the controller unit 300 includes a CD and/or DVD drive 350 in communication with the circuitry housed by the controller unit 300. The disk drive 350 allows the user to store, create (record), retrieve (playback), and share MIDI and audio files.

The pedal assembly 160 of the piano 100, in some examples, includes three pedals 161, 162, 163. The pedal assembly 160 includes a left pedal 161, which typically moves a hammer rail closer to the strings 140, in an upright piano, and moves the key frame sideways so that the hammers 130 strike two strings 140 instead of three strings 140, in a grand (horizontal) piano. The pedal assembly 160 includes a middle pedal 162 which may typically: 1) actuate a mute rail (e.g. via felt that drops between the hammers 130 and the strings 140); 2) actuate a bass sustain; 3) actuate a Sostenuto, which enables selected notes to be sustained independently from the others; or 4) non-exist, but is added for this assembly 160. In a grand piano, the middle pedal 162 is typically a Sostenuto pedal. The pedal assembly 160 includes a right pedal 163, which is typically a damper pedal. In some implementations, one of the pedals 161, 162, 163, preferably the middle pedal 162, is configured to control the piano play mode, e.g., switching between silent play mode and acoustic play mode. The mode selection pedal 162 may function as described above and/or as a play mode selector.

Figure 17:
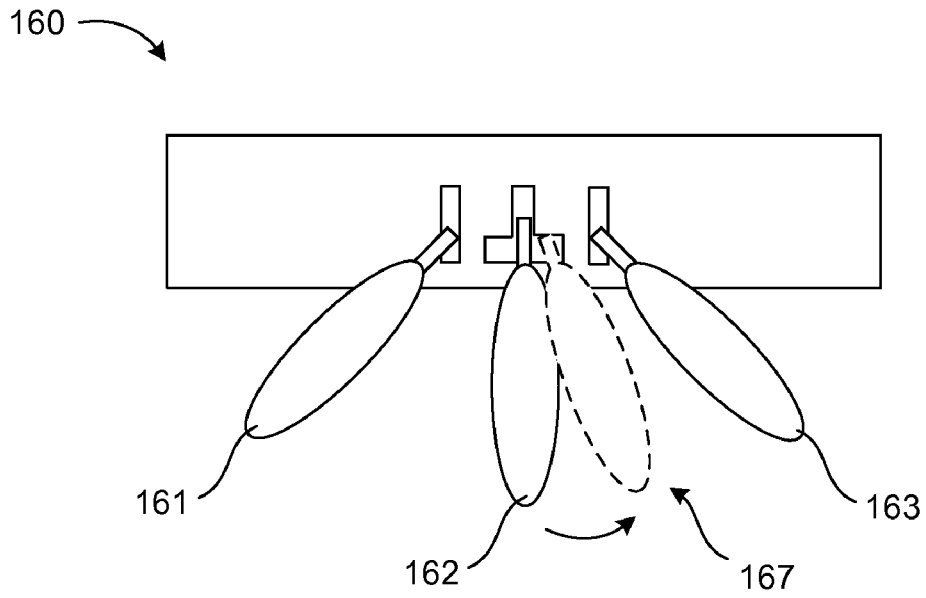
FIGS. 17-18 are perspective views of piano pedal assemblies.

Referring to FIG. 17, the silent play mode is engaged by pressing the mode selection pedal 162 downward and then rotating it laterally to a lockably engaged position 167 to hold the silent play mode. In one implementation, the mode selection pedal 162 engages the mode selection switch 150 when moved to the engaged position 167. The mode selection pedal 162 may be held in the engaged position 167 by a magnet, detent in a piano casing, or a bracket.

Figure 18:
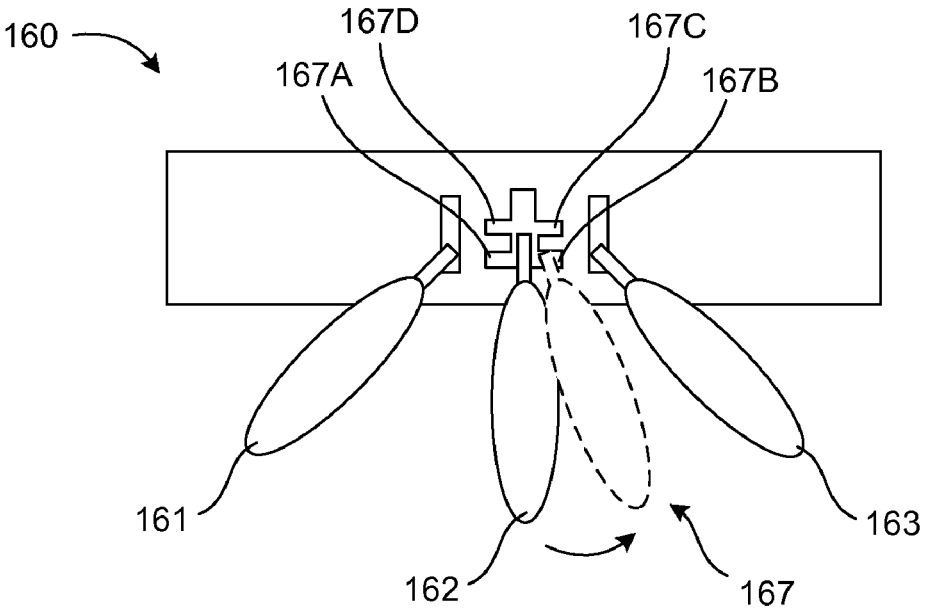

Referring to FIG. 18, in some implementations, the mode selection pedal 162 is a multi-stage piano pedal configured to be moved among 3-4 engageable positions by a user. A first engaged position 167A controls volume while the piano 100 is played in the silent/electronic mode. A second engaged position 167B controls switching between the acoustic and silent/electronic play modes. A third engaged position 167C in combination with another signal device (e.g. key, actuator button, lever, etc.) controls a predetermined or programmable set of specific functions. Optionally, a fourth engaged position 167D when depressed and locked can hold a particular function (e.g. actuate a stopper rail) until unlocked. The multistage pedal 162 may include a sensor system in communication with the controller unit 300, which detects the engaged positions 167A, 167B, 167C, 167D, allowing the controller unit 300 to respond accordingly.

Figure 19:
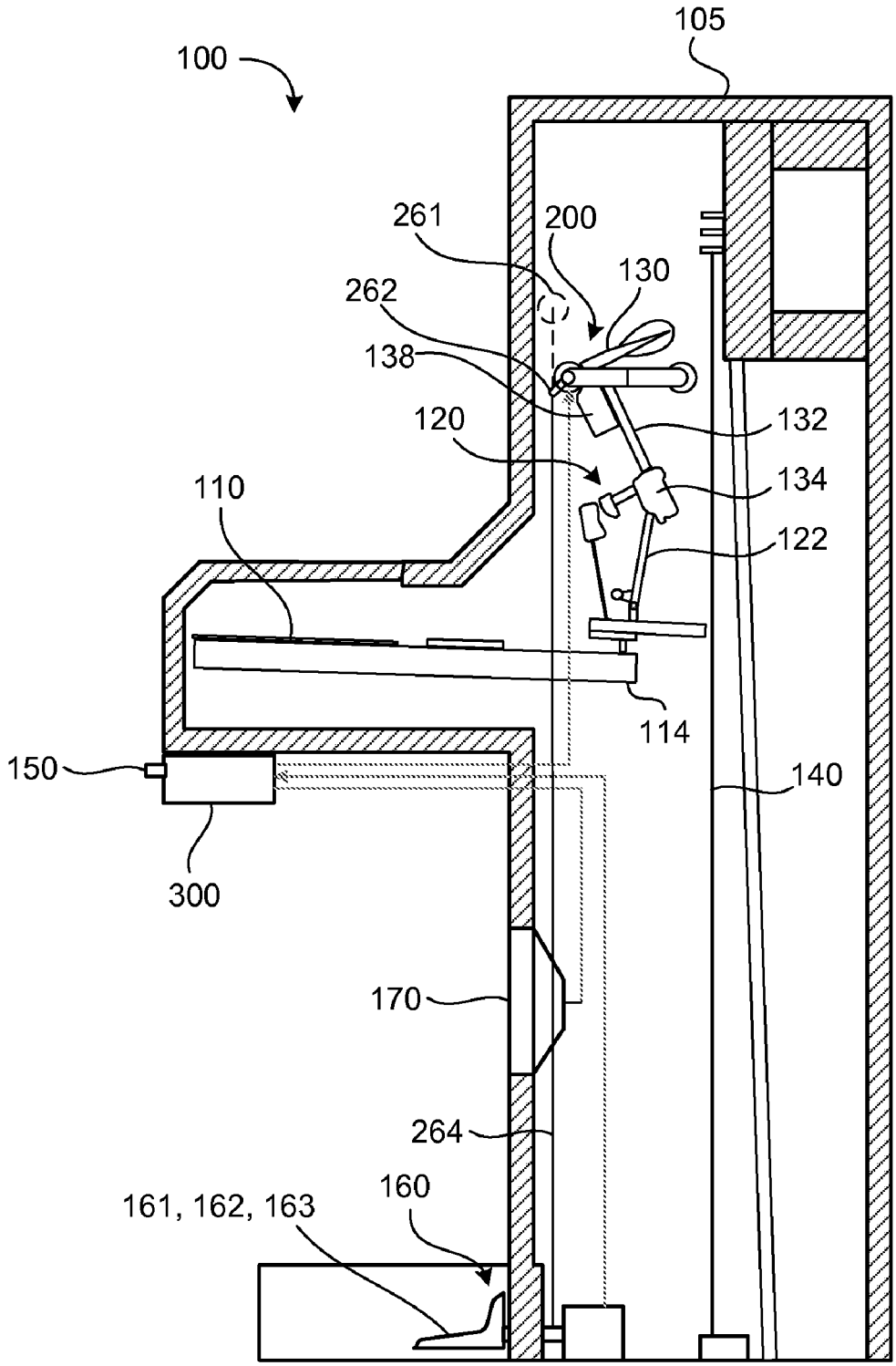
FIG. 19 is a section view of an upright piano with a hammer stopper system.

Referring to FIG. 19, in some implementations, the rail rotator 220, 260 includes at least one solenoid 261 driving a linkage 262 attached to the actuator rail 240, or a motor 260 coupled to the actuator rail 240 (FIG. 4), or a pedal actuator assembly 160. The pedal actuator assembly 160 includes a lever 262 attached to the actuator rail 240 and a link 264 attaching the lever 262 to a pedal 161, 162, 163. Actuation of the piano pedal 161, 162, 163 toggles the actuator rail 240 among its first and second positions.

A number of implementations have been described. Nevertheless, it will be understood that various modifications may be made without departing from the spirit and scope of the disclosure. Accordingly, other implementations are within the scope of the following claims.

What is claimed is:

1. A piano playable in an acoustic mode and a silent mode, the piano comprising:

a series of keys;

a series of key actions, each key action actuated by depression of a corresponding key;

a series of rotatable hammers, each defining a forward throw direction and having a corresponding string, the hammers being driven by corresponding key actions transferring forces from corresponding keys; and a hammer stopper system comprising:

a blocking rail slidably disposed forward of the hammers; and a linear actuator configured to move the blocking rail along a substantially linear path between a first position, allowing unobstructed movement of the hammers, and a second position blocking at least one hammer from striking its corresponding string;

wherein the linear actuator moves the blocking rail to the first position for acoustic play and to the second position for silent play.

2. The piano of claim 1, wherein the linear actuator comprises:

an actuator rail rotatably disposed behind the hammers, the actuator rail being rotatable between a first position and a second position; and at least one linkage assembly coupled to the actuator rail and the blocking rail for moving the blocking rail between the first position, allowing unobstructed movement of piano hammers, and the second position blocking at least one hammer from striking a corresponding string.

3. The piano of claim 2, wherein the linkage assembly comprises:

a first link attached to the actuator rail; and a second link pivotally coupled to the first link and to the blocking rail.

4. The piano of claim 1, wherein the linear actuator comprises:

at least one linear guide guiding movement of the blocking rail;

an actuator rail rotatably disposed behind the hammers, the actuator rail being rotatable among a first position and a second position; and at least one leash attaching the actuator rail to the blocking rail, the leash being arranged to translate rotation of the actuator rail to the blocking rail for moving the blocking rail between its first and second positions.

5. The piano of claim 4, wherein the linear guide comprises a telescoping guide, the telescoping guide having first and second ends, the first end being rotatably attached to the actuator rail, the second end being attached to the blocking rail, wherein rotation of the actuator rail from its first position to its second position moves the attached leash about the actuator rail, pulling the blocking rail towards the actuator rail.

6. The piano of claim 5, wherein the leash passes between the blocking rail and the actuator rail through a passageway defined through the telescoping guide.

7. The piano of claim 1, wherein the linear actuator comprises first and second counteracting rail actuators, the first rail actuator moving the blocking rail to its first position, the second rail actuator moving the blocking rail to its second position.

8. The piano of claim 1, further comprising a spring that biases the blocking rail toward its first position.

9. The piano of claim 1, further comprising a mode selection switch in communication with the linear actuator and controlling movement of the blocking rail among the first and second positions.

10. The piano of claim 9, wherein a pedal of the piano engages the mode selection switch.

11. The piano of claim 1, further comprising a controller in communication with the linear actuator and controlling switching among the acoustic play mode and the silent play mode, the controller comprising:

a controller housing;

circuitry carried by the controller housing; and a display in communication with the circuitry;

wherein the controller housing is slidably attached below a keyboard portion of the piano, the controller housing sliding among a stowed position and a deployed position.

12. A piano playable in an acoustic mode and a silent mode, the piano comprising:

a series of keys;

a series of key actions, each key action actuated by depression of a corresponding key;

a series of rotatable hammers, each defining a forward throw direction and having a corresponding string, the hammers being driven by corresponding key actions transferring forces from corresponding keys;

an actuator rail rotatably disposed behind the hammers, the actuator rail being rotatable among a first position and a second position;

at least one linear guide rotatably attached over the actuator rail;

a blocking rail disposed forward of the hammers and attached to the linear guide for moving along a substantially linear path among a first position, allowing unobstructed movement of the hammers, and a second position blocking at least one hammer from striking its corresponding string; and at least one leash attaching the actuator rail to the blocking rail, the leash being arranged to translate rotation of the actuator rail to the blocking rail for moving the blocking rail between its first and second positions;

wherein the actuator rail is rotated to its first position for acoustic play and its second position for silent play.

13. The piano of claim 12, wherein the at least one linear guide comprises a telescoping guide, the telescoping guide has first and second ends, the first end being rotatably attached to the actuator rail, the second end being attached to the blocking rail, wherein rotation of the actuator rail from its first position to its second position winds the attached leash about the actuator rail, pulling the blocking rail towards the actuator rail.

14. The piano of claim 13, wherein the leash passes between the blocking rail and the actuator rail through a passageway defined through the telescoping guide.

15. The piano of claim 12, further comprising a spring that biases the blocking rail toward its first position.

16. The piano of claim 12, further comprising a rail rotator configured to rotate the actuator rail between its first and second positions.

17. The piano of claim 16, wherein the rail rotator comprises:

a lever attached to the actuator rail; and a link attaching the lever to a pedal of the piano; wherein actuation of the piano pedal toggles the actuator rail among the first and second positions.

18. The piano of claim 16, wherein the rail rotator comprises at least one solenoid driving a linkage attached to the actuator rail.

19. The piano of claim 16, wherein the rail rotator comprises a motor coupled to the actuator rail.

20. The piano of claim 12, further comprising a mode selection switch in communication with the rail rotator and controlling rotation of the actuator rail among its first and second positions.

21. The piano of claim 20, wherein a pedal of the piano engages the mode selection switch.

22. The piano of claim 12, further comprising a controller in communication with the rail rotator and controlling switching among the acoustic play mode and the silent play mode.

23. The piano of claim 12, wherein the controller comprises:

a controller housing;

circuitry carried by the controller housing; and a display in communication with the circuitry;

wherein the controller housing is slidably attached below a keyboard portion of the piano, the controller housing sliding among a stowed position and a deployed position.

24. A piano playable in an acoustic mode and a silent mode, the piano comprising:

a series of keys;

a series of key actions, each key action actuated by depression of a corresponding key;

a series of rotatable hammers, each defining a forward throw direction and having a corresponding string, the hammers being driven by corresponding key actions transferring forces from corresponding keys; and a hammer stopper system comprising:

an actuator rail rotatably disposed behind the hammers, the actuator rail being rotatable among a first position and a second position;

a blocking rail rotatably disposed forward of the hammers, the blocking rail being rotatable among a first position and a second position; and one or more leashes secured to the actuator rail, each leash arranged to translate rotation of the actuator rail to the blocking rail, the blocking rail stopping at least one hammer from striking a corresponding string when the blocking rail is rotated from the first position to the second position;

wherein the actuator rail is rotated to its first position for acoustic play and its second position for silent play.

25. The piano of claim 24, wherein the leash has first and second ends both secured to the actuator rail, the leash looping around the blocking rail.

26. The piano of claim 24, further comprising at least one leash adjustment screw disposed on the actuator rail and configured to adjust a length of the associated leash.

27. The piano of claim 24, further comprising a rail rotator configured to rotate the actuator rail between its first and second positions.

28. The piano of claim 27, wherein the rail rotator comprises:

a lever attached to the actuator rail; and a link attaching the lever to a pedal of the piano; wherein actuation of the piano pedal toggles the actuator rail among the first and second positions.

29. The piano of claim 27, wherein the rail rotator comprises at least one solenoid driving a linkage attached to the actuator rail.

30. The piano of claim 27, wherein the rail rotator comprises a motor coupled to the actuator rail.

31. The piano of claim 24, further comprising a mode selection switch in communication with the rail rotator and controlling rotation of the actuator rail among its first and second positions.

32. The piano of claim 31, wherein a pedal of the piano engages the mode selection switch.

33. The piano of claim 24, further comprising a controller in communication with the rail rotator and controlling switching among the acoustic play mode and the silent play mode, the controller comprising:

a controller housing;

circuitry carried by the controller housing; and a display in communication with the circuitry;

wherein the controller housing is slidably attached below a keyboard portion of the piano, the controller housing sliding among a stowed position and a deployed position.

34. A hammer stopper system for a piano, the hammer stopper system comprising:

a blocking rail;

at least one linear guide attached to the blocking rail;

an actuator rail rotatably coupled to the linear guide, the actuator rail being rotatable among a first position and a second position; and at least one leash attaching the actuator rail to the blocking rail, the leash being arranged to translate rotation of the actuator rail to the blocking rail for moving the blocking rail between a first position, allowing unobstructed movement of hammers of the piano, and a second position blocking at least one hammer from striking a corresponding string.

35. The hammer stopper system of claim 34, wherein the at least one linear guide comprises a telescoping guide, the telescoping guide has first and second ends, the first end being rotatably attached to the actuator rail, the second end being attached to the blocking rail, wherein rotation of the actuator rail from its first position to its second position winds the attached leash about the actuator rail, pulling the blocking rail towards the actuator rail.

36. The hammer stopper system of claim 35, wherein the leash passes between the blocking rail and the actuator rail through a passageway defined through the telescoping guide.

37. The hammer stopper system of claim 34, further comprising a spring that biases the blocking rail toward its first position.

38. A hammer stopper system for a piano, the hammer stopper system comprising:

a blocking rail; and a linear actuator configured to move the blocking rail between a first position, allowing unobstructed movement of piano hammers, and a second position blocking at least one hammer from striking its corresponding string;

wherein the linear actuator comprises:

an actuator rail being rotatable between a first position and a second position; and at least one linkage assembly coupled to the actuator rail and the blocking rail for moving the blocking rail between the first position, allowing unobstructed movement of piano hammers, and the second position blocking at least one hammer from striking a corresponding string; and wherein the linear actuator moves the blocking rail to the first position for acoustic play and to the second position for silent play.

39. The hammer stopper system of claim 38, wherein the linkage assembly comprises:

a first link attached to the actuator rail; and a second link pivotally coupled to the first link and to the blocking rail.

40. The hammer stopper system of claim 38, further comprising a spring that biases the blocking rail toward its first position.

* * * * *